US008195539B1

(12) United States Patent
Mitchell et al.

(10) Patent No.: US 8,195,539 B1
(45) Date of Patent: Jun. 5, 2012

(54) OPEN ACCESS TRANSMISSION TARIFF INFORMATION SYSTEM

(75) Inventors: Eugenia A. Mitchell, Stone Mountain, GA (US); Patrice L. Shaver, Dunwoody, GA (US)

(73) Assignee: Southern Company Services, Inc., Atlanta, GA (US)

( * ) Notice: Subject to any disclaimer, the term of this patent is extended or adjusted under 35 U.S.C. 154(b) by 416 days.

(21) Appl. No.: 12/498,068

(22) Filed: Jul. 6, 2009

(51) Int. Cl.
*G07F 19/00* (2006.01)

(52) U.S. Cl. ..... 705/34

(58) Field of Classification Search ..... 705/400, 705/412, 63, 1.1, 7.11, 7.12, 7.22, 7.23–7.37, 705/28–35, 36 R, 36 T, 22, 26.1–26.3, 37–40, 705/348; 700/286, 291, 295, 296; 703/2, 703/6, 13, 17, 18
See application file for complete search history.

(56) References Cited

U.S. PATENT DOCUMENTS

| | | | | |
|---|---|---|---|---|
| 6,909,941 | B2 * | 6/2005 | Scott et al. | 700/286 |
| 7,305,281 | B2 * | 12/2007 | Scott et al. | 700/286 |
| 2005/0234600 | A1 * | 10/2005 | Boucher et al. | 700/286 |
| 2009/0089193 | A1 * | 4/2009 | Paintin | 705/34 |

* cited by examiner

*Primary Examiner* — Igor Borissov
(74) *Attorney, Agent, or Firm* — John J. Timar; Womble Carlyle Sandridge & Rice LLP

(57) ABSTRACT

A method, system, and computer readable storage medium for open access transmission tariff management for a utility. The system includes a database for storing a plurality of data pertaining to providing transmission service to wholesale customers, and a computer processor coupled to the database and cooperative with a plurality of subsystems. A first subsystem determines a budget transmission billing rate. A second subsystem estimates revenue from wholesale customers. A third subsystem determines an updated budget transmission billing rate and an updated revenue projection. A fourth subsystem determines an actual transmission billing rate. A fifth subsystem analyzes a billed transmission rate on a periodic basis.

18 Claims, 23 Drawing Sheets

OPEN ACCESS TRANSMISSION TARIFF INFORMATION SYSTEM

TECHNICAL FIELD

Embodiments of the invention are directed generally to transmission of electrical power to wholesale customers and, more particularly, to information systems for open access tariff transmission.

BACKGROUND OF THE INVENTION

In order to promote energy generation competition and enforce fair treatment of external users of the transmission system, the Federal Energy Regulatory Commission issued Orders 888 and 889 in April 1996. Among other requirements, Order 888 required all electric utilities to file an open-access transmission tariff (OATT). Order 889 defined how all participants in the electricity market should interact with transmission providers and provided the structure and function for open access same-time information system (OASIS). OASIS nodes are secure, web-based interfaces to each transmission system's market offerings and transmission availability announcements.

Non-discriminatory open access is required for an electric utility company's competitive generation business to sell at market based rates. The OATT (Open Access Transmission Tariff) is the body of rules that govern how wholesale transmission customers receive transmission service from an electric utility. These rules encompass not only the calculation of a formulary rate, but also all of the terms under which wholesale customers receive service.

Electric utility companies in the U.S. earn wholesale revenues by providing transmission service to wholesale customers under the terms of the FERC-approved Open Access Transmission Tariff (OATT). The categories of service under the OATT include network and long-term firm point-to-point service (service periods of one year or longer), short-term firm point-to-point service (daily, weekly or monthly service periods) and non-firm point-to-point service (hourly, daily, weekly or monthly service as available). Electric utilities also collect transmission revenues through grandfathered agreements pre-dating the OATT and other miscellaneous transmission services performed for other utilities.

The development, FERC filing and defense of the OATT rate has been accomplished in the past through the use of over 200 different spreadsheets and numerous manual processes. Since the inception of the formulary OATT in 2002, the demands of the OATT rate have increased. The old model technology was found to be no longer adequate.

Furthermore, over the past few years, there has been a dramatic increase in the scrutiny of the filings and in the number of questions that were received during both the Informational and True-Up filing informal review periods. The primary questions have come from the transmission network customers who have hired lawyers and consultants to handle the review process and work with the electric utility in reaching settlements on any issues raised. These review processes have become drawn out reviews most often resulting in lengthy settlement processes. They involve a lot of time and resources for an electric utility. There is no indication that the current environment will not continue in the future.

In any given calendar year, there are essentially three separate FERC OATT rate filings ongoing. These are calculation of the next year billing rate, the true-up of the past year's billing rate, and the implementation of the current year's billing rate. Because the informal review process has been extended far beyond the normal 90 day period due to the intense intervention by the network customers, an electric utility is most often dealing with data responses and analysis on concurrent filings at the same time. The technical system or the resources to adequately provide timely and accurate information did not exist.

SUMMARY OF THE INVENTION

Embodiments described herein provide a system to assist in the OATT rate development, analysis, filing and providing data responses as required in the OATT process. The system is referred to herein as the Open Access Transmission Tariff Information System (OATTIS).

In one embodiment of the invention, a web-based system, method, and computer readable storage medium are provided for open access transmission tariff management for a utility. The system includes a database for storing a plurality of data pertaining to providing transmission service to wholesale customers, and a computer processor coupled to the database and cooperative with a plurality of subsystems. A first subsystem determines a budget transmission billing rate based on at least one of a plurality of forecast loads, revenue credits, and current budget data for the utility. A second subsystem estimates revenue from wholesale customers based on at least one of bulk transmission, sub-transmission, long term firm, short term firm, non-firm, and network service projections for the utility. A third subsystem determines an updated budget transmission billing rate and an updated revenue projection based on at least one of expected transmission plant investment, cost of debt, expected transmission operation and maintenance expenses, transmission loads and collection of short term and non-firm service charges. A fourth subsystem determines an actual transmission billing rate based on at least one of actual loads for bulk and sub-transmission, and revenue credits. A fifth subsystem analyzes a billed transmission rate on a periodic basis.

BRIEF DESCRIPTION OF THE DRAWINGS

These and other advantages and aspects of the embodiments of the invention will become apparent and more readily appreciated from the following detailed description of the embodiments taken in conjunction with the accompanying drawings, as follows.

DETAILED DESCRIPTION

Figure 1:
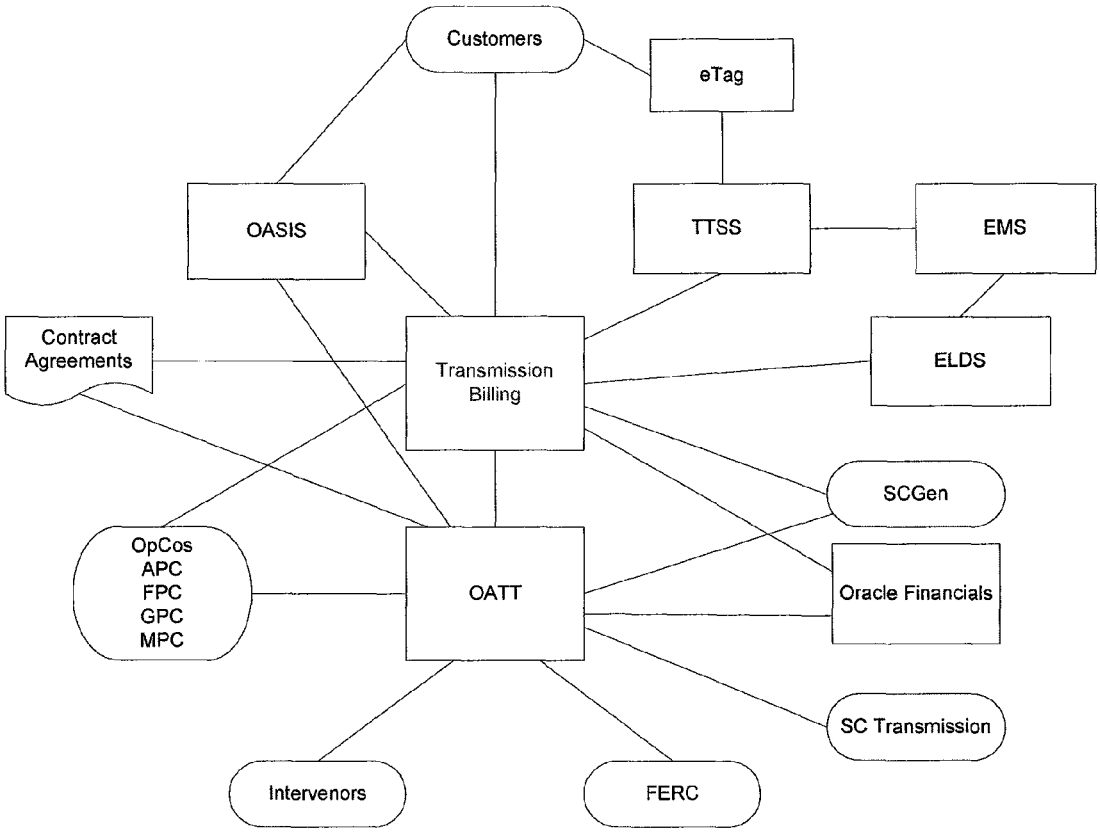
FIG. 1 illustrates an exemplary high level functional overview of wholesale transmission revenue.

The following description is provided as an enabling teaching of embodiments of the invention including the best, currently known embodiment. Those skilled in the relevant art will recognize that many changes can be made to the embodiments described, while still obtaining the beneficial results of the disclosed embodiments. It will also be apparent that some of the desired benefits of the embodiments described can be obtained by selecting some of the features of the disclosed embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

The Open Access Transmission Tariff Information System (OATTIS) is a web-based computer software application that automates the Open Access Transmission Tariff (OATT) processing for an electricity company. In exemplary embodiments, the OATTIS system uses the following development platform, and equivalents thereof:

1. Presentation Layer: thick client with Window forms;
2. Business layer: .Net technology with C# language;
3. Data layer: Oracle database;
4. GUI Control: from SpreadsheetGear, LLC.

OATTIS addresses the following concerns: (1) mitigation/minimization of the risk of non compliance with the OATT settlement; (2) mitigation/minimization of the risk of inaccurate and untimely information; (3) compliance with Sarbanes-Oxley, FERC and Electric Reliability Organization (ERO) regulations and requirements; (4) minimization of the number of intervener questions; (5) facilitation of timely and accurate responses with the intention of reducing the length of time required in the informal review process at a minimum back to the 90 day period following the OATT filing by reducing the number of questions received from interveners, and the resource requirements of responding to the number of intervener questions and facilitating responses; and (6) maintaining and enhancing credibility with OATT customers to allow for a continued profitable OATT revenue stream.

The OATTIS system creates models and calculates the OATT rates that are utilized to bill external wholesale transmission service customers. These rates are filed with FERC through the Informational Filing. Monthly actual versus budget reports are produced with allocations at the operating company level. Quarterly analysis of the OATT rates is performed. Annually, the prior year's rates are "trued-up" based on the True-Up Filing that is filed with FERC. The customers and their interveners can ask any questions that are deemed appropriate about the Informational and True-Up Filings.

OATTIS replaces the old extensively manual Excel spreadsheet-based OATT processing with an automated solution that fully utilizes technology to achieve the following advantages and benefits: (1) compliance with Sarbanes-Oxley, FERC and ERO regulations and requirements; (2) central repository/source for transmission financial and accounting data; (3) data security and integrity; (4) automated data input with validation; (5) model versioning with full retention of model, data and audit trail of build and changes; (6) analysis of model to yield more accurate rates; and (7) separation of tasks to yield more checks and balances.

In an exemplary embodiment, the Open Access Transmission Tariff Information System (OATTIS) reengineers and replaces the processes and spreadsheets that were the basis for Open Access Transmission Tariff (OATT) processing. OATT processing includes three primary processes: (1) Budget Rate; (2) Analysis of Billed Rate; (3) Actual Rate.

Budget Rate

The Budget Rate Process is started each year by reviewing the prior year's models, analyzing new FERC Orders, and accounting changes and updates to determine if changes are needed to the Budget Rate Model. In exemplary embodiments, the inputs to the Budget Rate Model include forecast loads, revenue credits, current budget data for Operating Companies, carryovers from Prior Year True-Up Filing, and new FERC Orders, and accounting changes and updates. After the necessary changes are applied to the model, budget and estimated data from the data providers (Operating Companies, Electric Utility Company Generation) is loaded into the Budget Rate Model and 10 years of forecasted Bulk-Network and Non-Firm, Bulk-Firm, and Sub-Transmission OATT Rates are calculated. The forecasted OATT Rates and projected (estimated) sales information are applied to the Revenue Model to produce a budget Revenue Model with 10 years of OATT revenue projections by revenue type and Operating Company (OPCO). The outputs from the Budget Rate Model include Bulk Transmission OATT Rates for 10 Years, Sub-Transmission OATT Rates for 10 Years, Budget Rate Model Exhibits, and Informational Filing Exhibits.

The OATT Informational (Rate) Filing is driven by the Budget Rate Model Process and begins immediately following the completion of the Budget Rate Model Process. The Informational Filing contains the first budget year from the Budget Rate Model and does not use the forecast years. All Exhibits for the first budget year are included in the November 1st filing with the FERC and the wholesale customers.

Both FERC and the wholesale customers have the option to question the filing information and how it was prepared for 90 days after the filing date. Answers are provided within 10 business days (two weeks) of receipt of submitted questions. The questions are continued through the process until agreement or resolution is reached.

After the first budget year rate from the Budget Rate Model has been filed through the Informational Filing, the rates are loaded to OASIS and the Transmission Billing System (TBS) to be utilized for reservations and billing for the next year.

Analysis of Billed Rate

In an exemplary embodiment, two major processes are utilized to analyze the billed rate: (1) monthly budget to actual reconciliation and review, and (2) OATT Quarterly Rate accuracy review process.

Monthly Budget to Actual Reconciliation and Review Process

The approved budget for transmission is reviewed monthly against actual revenue received. The Transmission Billing department of the utility is responsible for sending out the invoices to the customers and sending the Transmission Pool Invoice to the utility's Financial Reporting group. The Financial Reporting team uses the Transmission Pool Invoice as the control for the monthly reconciliation. The Financial Reporting team takes the data from billing and produces budget to actual reports for the operating companies of the utility and executive management. The monthly process organizes the data in a number of different views, including, but not limited to: revenue type, operating company, FERC account, and service type. Revenue types can include: (1) bulk transmission revenues, (2) sub-transmission revenues, (3) distribution revenues, (4) ancillary revenues (high level or breakdown), and (5) FERC charges. Service types can include: (1) long-term firm, (2) short-term firm, (3) non-firm, and (4) network. Long term refers to service reservations of at least one year; short term refers to service period under a year. Firm means that the service cannot be interrupted for economic reasons and is intended to remain reliable even under adverse conditions.

The inputs for the analysis include: current budget revenue model information; monthly Pool Invoice; files containing revenues for Network customers; sub-transmission revenues; PTP (Point to Point) service revenues; and non-OATT revenues for grandfathered transmission service. The outputs for the analysis include: monthly actual revenues by company, by service type, by FERC account versus budget information. The available reports that are generated include, but are not limited to: (1) variance explanation and overall snapshot of OATT budget to actual information; summary and detailed reports by operating company and the utility company parent of the operating companies.

OATT Quarterly Rate Accuracy Review Process

There are two distinct processes involved in the OATT quarterly rate review process depending on the quarter. The first quarter is essentially a repeat of the informational filing. The final/approved budget information is requested from the OPCOs and the informational filing calculation process is repeated. For the other quarters, the process includes the update of several critical elements and the recalculation of the rate. The critical elements in an exemplary embodiment can include: (1) expected transmission plant investment, (2) expected transmission operation and maintenance expenses, (3) cost of debt, (4) transmission loads, and (5) collection of short term firm (ST) and non-firm (NF) charges.

The inputs for the first quarter analysis include: (1) updated operating company budget information; (2) current budget rate model information; (3) Open Access Transmission Tariffs by operating company; (4) analysis of taxes other then income taxes; (5) rate base adjustments by operating company; (6) analysis of plant exclusions by operating company; (7) analysis of capitalization; (8) development of materials and supplies balances from FERC Form 1; (9) determination of investment and expense components by operating company; (10) analysis of investment and expense components; (11) analysis of revenue credits; (12) analysis of sub-transmission loads with 12 month average; and (13) summary of transmission revenue requirement and charges. The output for the first quarter analysis is an updated budget rate. The report generated is revenue expectation updates based on the outcome of the quarterly review process.

The inputs for the other quarterly analyses include the approved budget and the following: (1) expected transmission plant investment; (2) expected transmission operations and maintenance expenses; (3) cost of debt; (4) load; and (5) collection of short term firm (ST) and non-firm (NF) charges. The output is the updated budget rate, and the report generated is revenue expectation updates based on the outcome of the quarterly review process.

Actual Rate

The Actual Rate Process is started each year by reviewing the previous year's actual rate and revenue models. New FERC orders and accounting changes and updates are analyzed to determine if changes are needed to the Actual Rate Model. Actual loads for bulk and sub-transmission, revenue credits, FERC Form 1 data and non-Form 1 data are obtained from the operating companies and loaded to the Actual Rate Model. The Actual Rate Model is for only one year; i.e., the year that was billed during the previous year. After calculation, review and analysis, the actual bulk and sub-transmission rates are applied to the Actual Rate Model.

The OATT True-Up (Rate) Filing is driven by the Actual Rate Model process and begins immediately following the completion of the Actual Rate Model Process. The True-Up Filing contains all Exhibits for the actual rates that were calculated through the Actual Rate Model. The True-Up Filing is filed with FERC and the wholesale customers. Both FERC and the wholesale customers have the option to question the filing information for 90 days after the filing date. Answers are provided within 10 business days of receipt of the questions. The questions are continued through the process until agreement or resolution is reached.

After the actual rate has been filed through the True-Up Filing, the actual rate is loaded to OASIS and refunds or invoices are created through the Transmission Billing System. The inputs to the actual rate process include, but are not limited to: (1) prior year actual rate model; (2) actual bulk and sub-transmission loads; (3) revenue credits; (4) Federal Energy Regulatory Commission (FERC) Form 1 data; and (5) non-Form 1 data. Non-Form 1 data includes, but is not limited to, generation step up transformer information, interconnection facility information, EPRI dues, Federal income taxes, and State income taxes. The outputs from the actual rate process include, but are not limited to, long term firm customers OATT rate, short term firm customers OATT rate, non-firm customers OATT rate, network customers OATT rate, and base for transmission revenue. The reports generated by the actual rate process include, but are not limited to, tariff filing, summary of transmission revenue requirements and charges, and tariff pages to OASIS containing: (1) firm rates, (2) non-firm rates, and (3) network rates.

The following description provides further detailed explanation of the exemplary embodiments. FIG. 1 illustrates an exemplary high level functional overview of wholesale transmission revenue. The functional scope of the wholesale transmission business involves many entities within and outside of the utility. The two primary financial/accounting areas of the wholesale transmission business are Transmission Billing and the Open Access Transmission Tariff (OATT). OATT processing develops the billing rate and estimated revenues. OATT then analyzes budget to actual revenues and determines needed true-up to the actual billing rate. Transmission Billing bills the wholesale customers based on reservations, scheduling, usage data, and billing rate.

Figure 2:
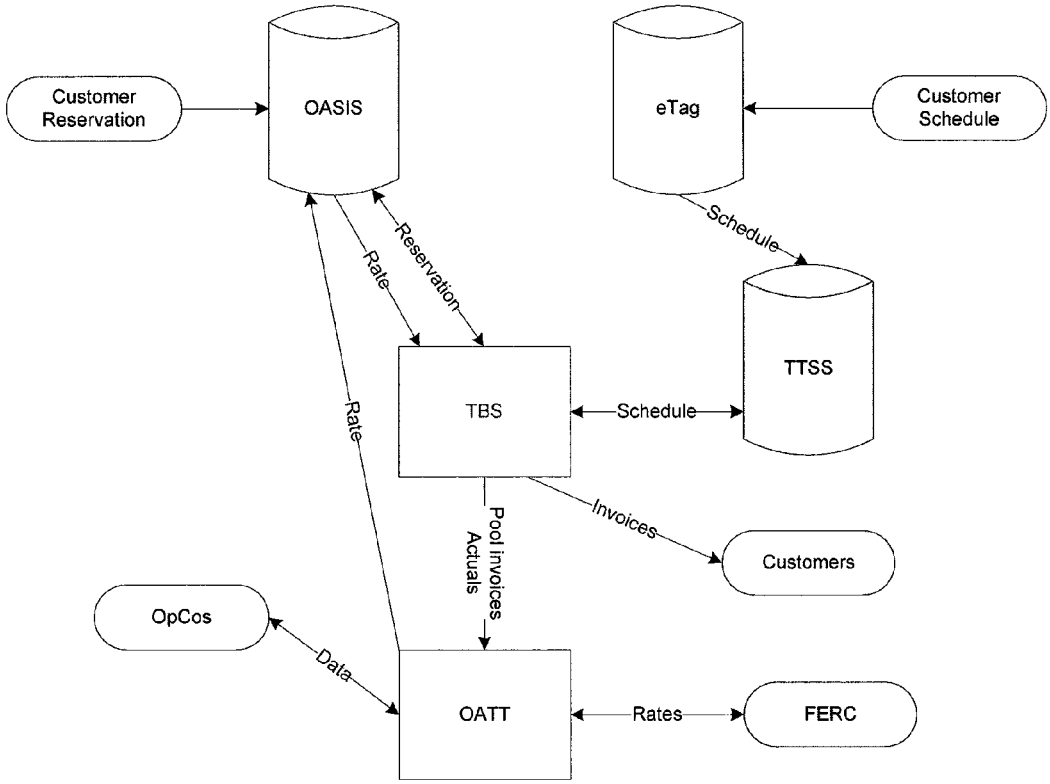
FIG. 2 illustrates an exemplary high level conceptual diagram of wholesale transmission revenue.
Figure 3:
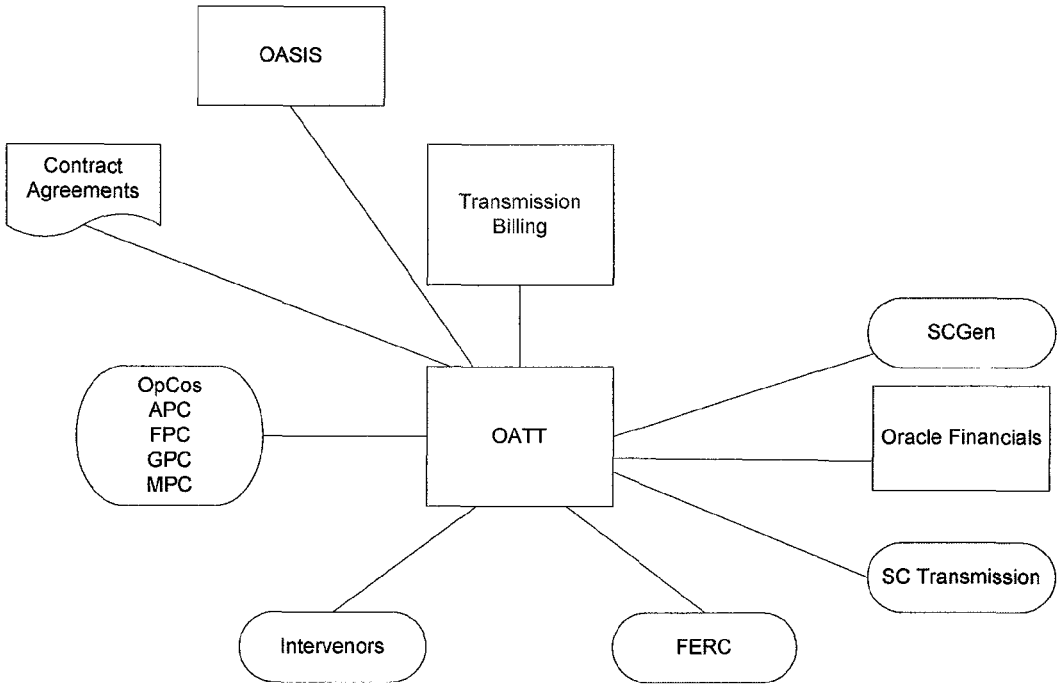
FIG. 3 illustrates an exemplary functional overview of the OATTIS subset of wholesale transmission revenue.
Figure 4:
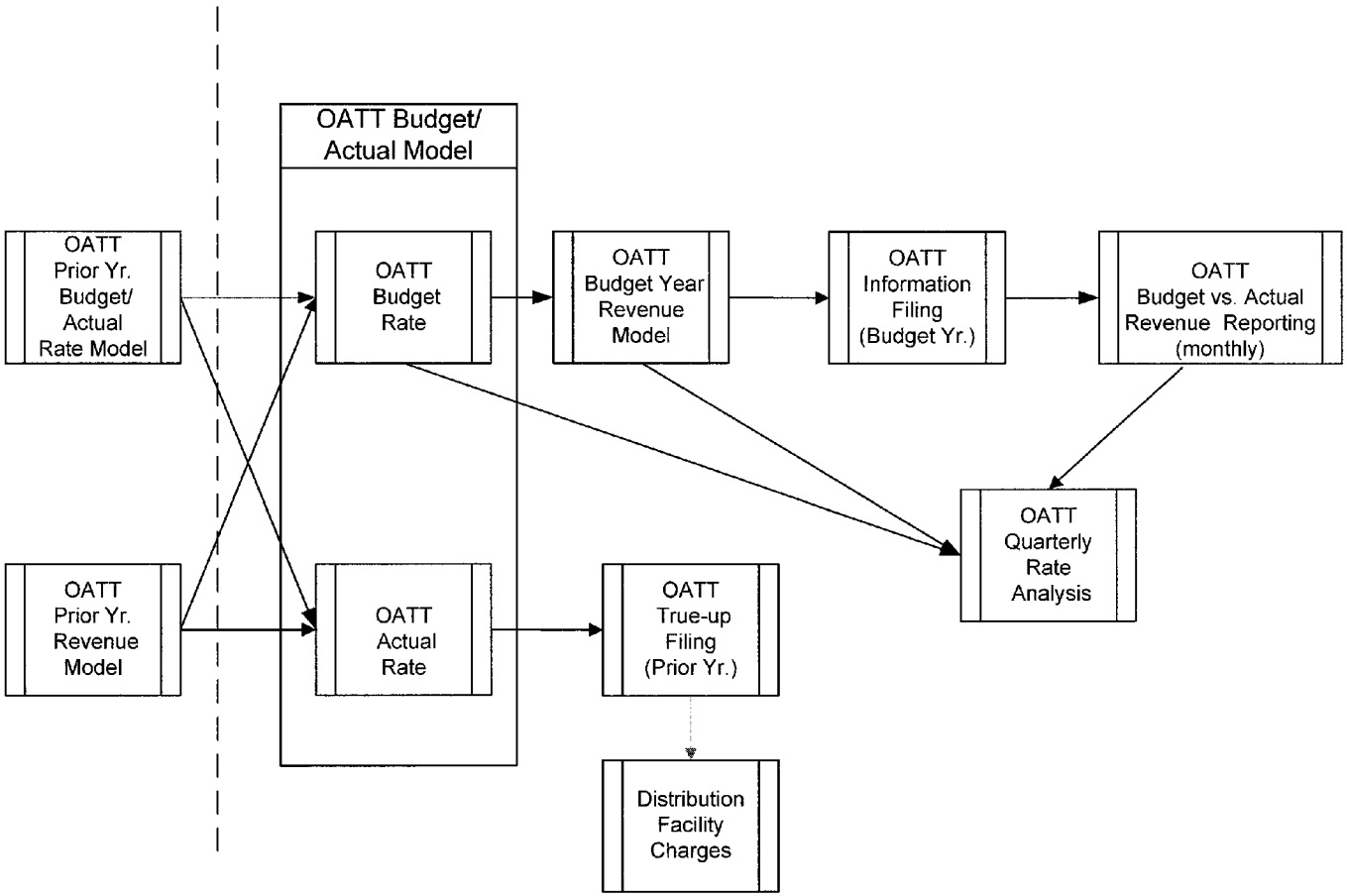
FIG. 4 illustrates an exemplary logical sequence flow of the primary functions of the OATTIS system.
Figure 5:
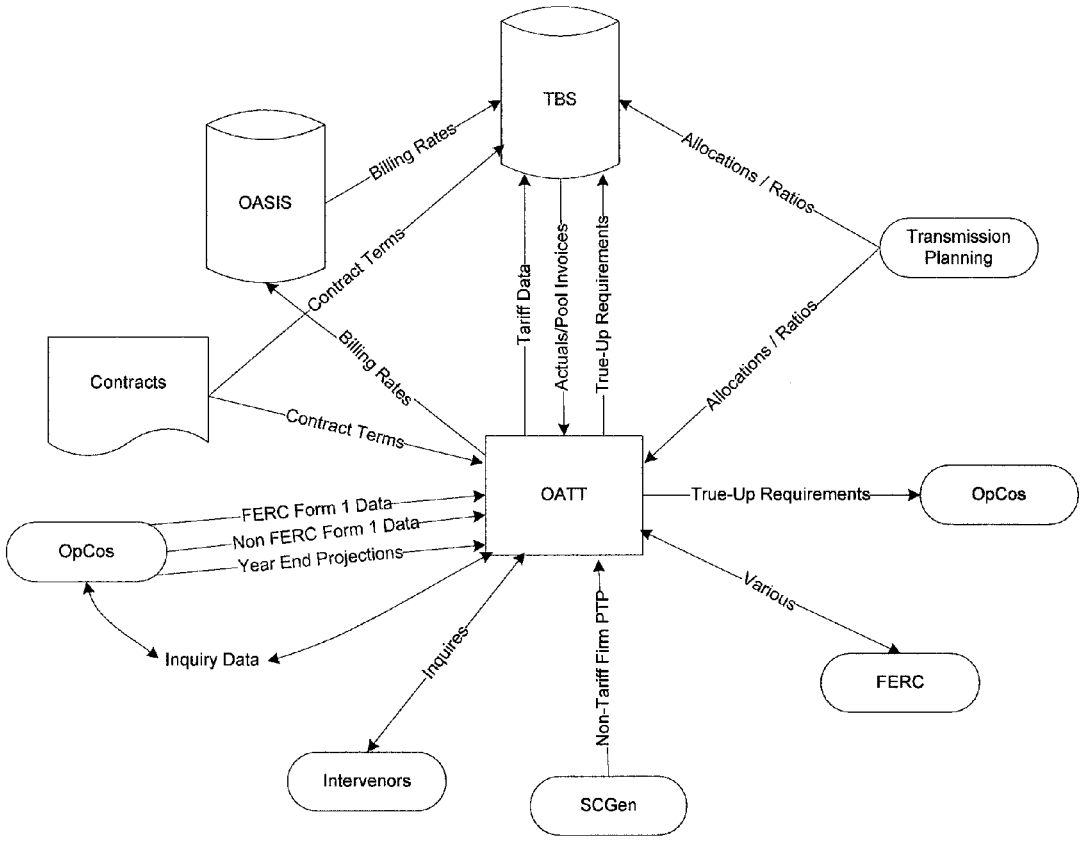
FIG. 5 illustrates an exemplary system and manual interfaces between components of the OATTIS subset of wholesale transmission revenue.

FIG. 2 illustrates an exemplary high level conceptual diagram of wholesale transmission revenue. FIG. 3 illustrates an exemplary functional overview of the OATTIS subset of wholesale transmission revenue. The primary OATT processes and functions include the budget rate model, budget year revenue model, information filing, budget/actual monthly reporting, quarterly rate true-up analysis, actual rate model, true-up filing, and distribution facility charge. FIG. 4 illustrates an exemplary logical sequence flow of the primary functions of the OATTIS system. There is a plurality of sub-processes within each of the processes shown. FIG. 5 illustrates an exemplary system and manual interfaces between components of the OATTIS subset of wholesale transmission revenue.

Budget Rate Model

Figure 6:
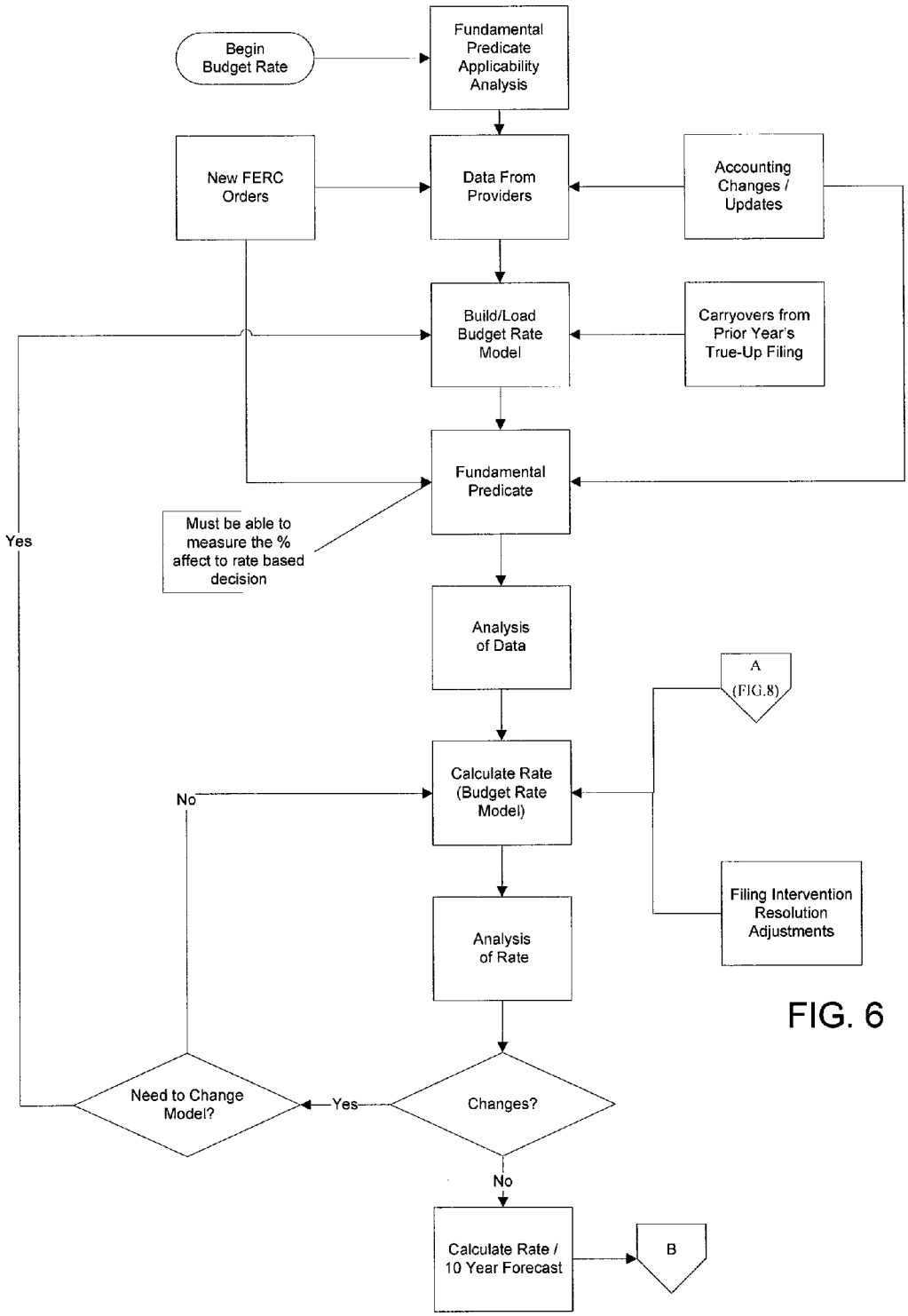
FIG. 6 illustrates an exemplary sequence of steps for the OATTIS budget rate model.

FIG. 6 illustrates an exemplary budget rate model for the OATTIS system. The data that has been loaded to the rate model is analyzed before rate calculation for reasonableness. If large changes are found, clarification is requested from the supplying data provider. After the variance clarifications are negotiated with the data provider, any necessary changes are made to the data. The variances and clarification/explanation must be retained with the model for future use to answer intervener questions. After the operating company budget data, load forecasts and revenue credits are loaded to the model and analyzed, the budget rates are calculated. Revenue credits are a determination of non-service revenues associated with general plant of transmission assets and the allocation of bulk and sub-transmission rates. These credits come from payments for a transmission facility or service that is not rendered as a transmission load service. Forecast loads are a combination of territorial loads, unit power sales (UPS), long term firm (LTF) and network sales and are used as part of the budget rate calculation.

Figure 10A:
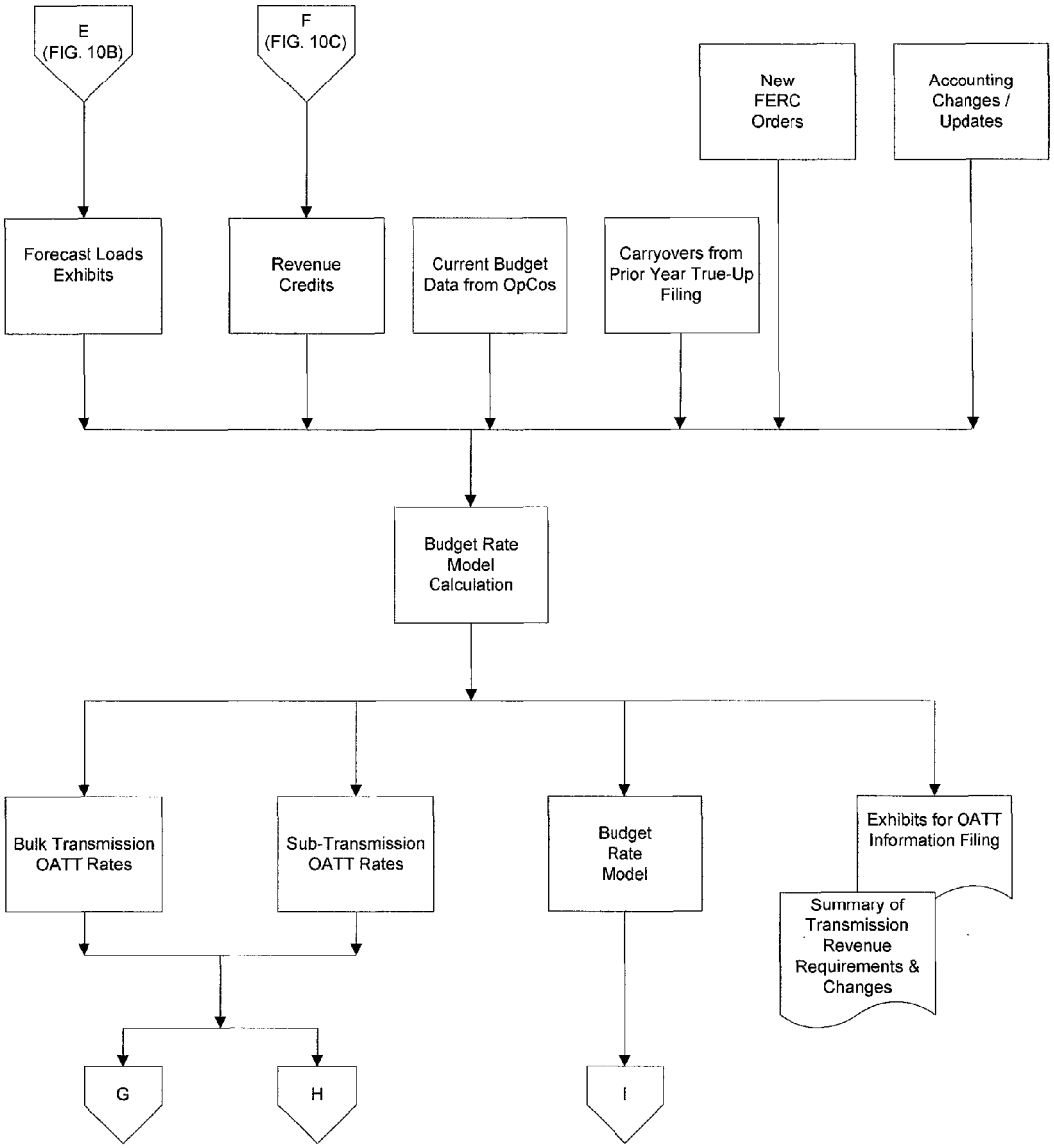
FIGS. 10A-10C illustrate exemplary data flows for the OATTIS budget rate model.
Figure 10B:
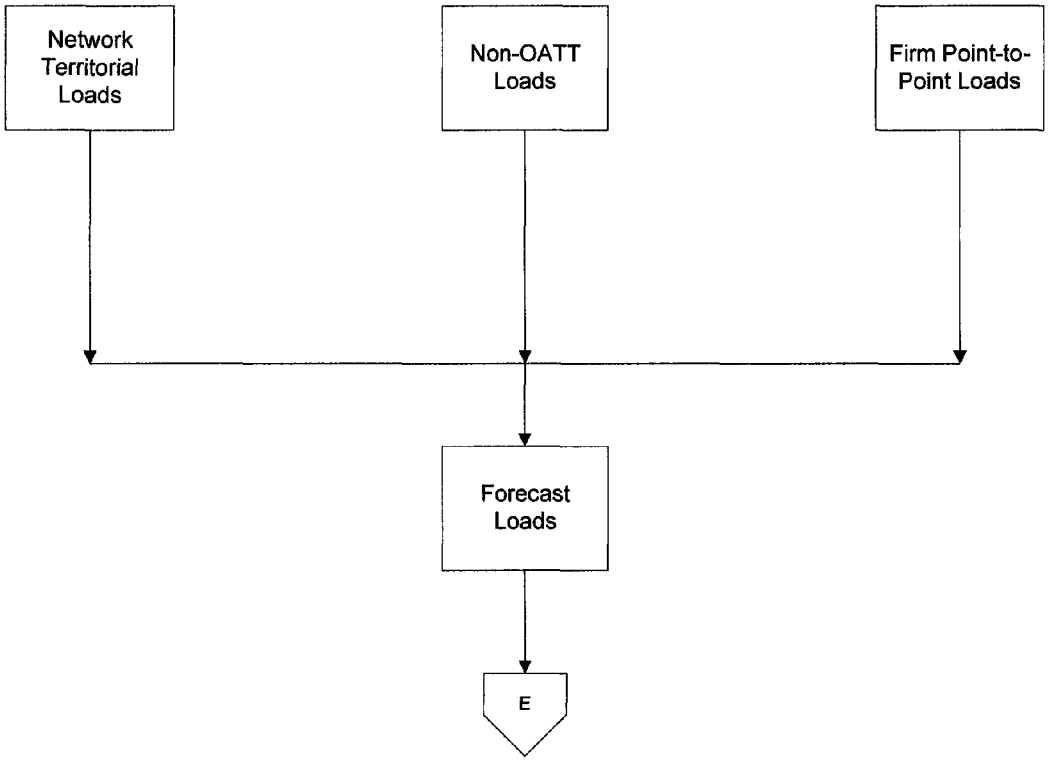
Figure 10C:
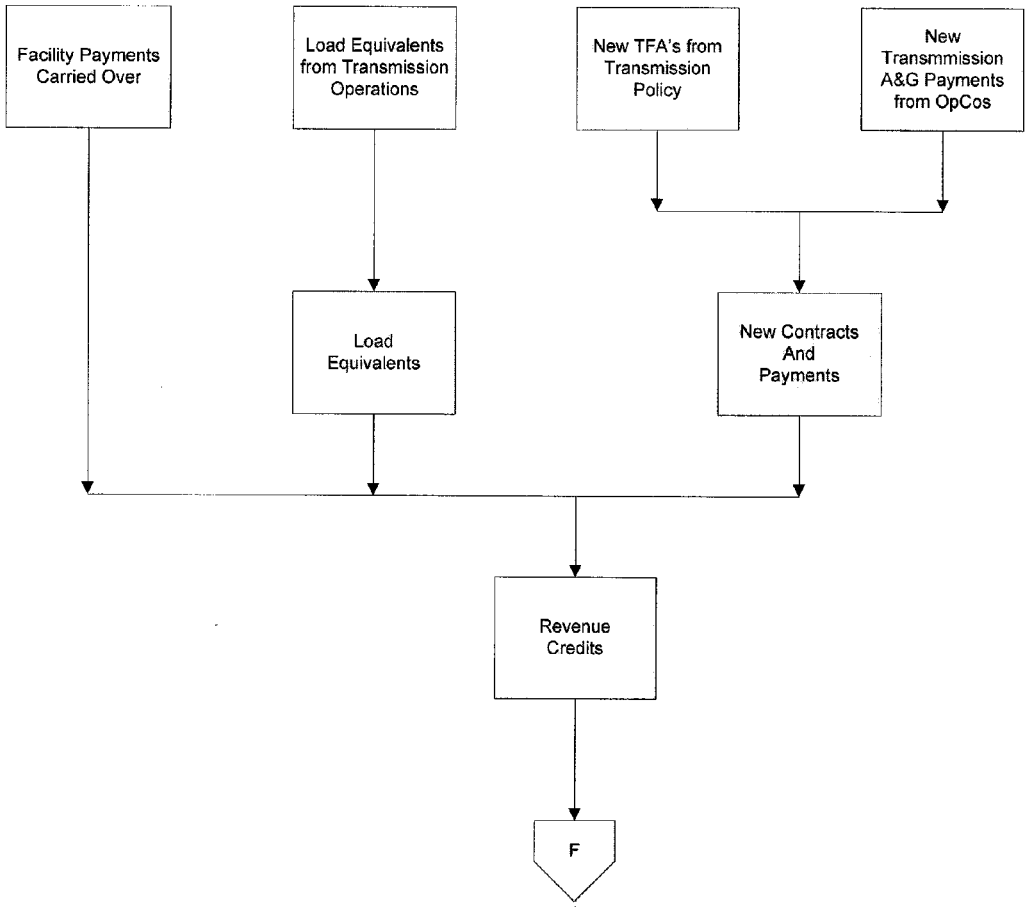

After the OATT budget rates have been calculated, various analyses (+/− thresholds) are performed to determine the validity of the budget model and resulting rates. These analyses include: (1) calculated rate versus forecasted rate for the year; (2) calculated rate versus billed rate from prior year; (3) calculated rate versus actual rate from prior year; and (4) percent change (increase or decrease). If needed changes result from these analyses, the calculate rate sub-process would be repeated to reflect the changes. FIGS. 10A-10C illustrate exemplary data flows for the OATTIS budget rate model.

Revenue Model

Figure 7:
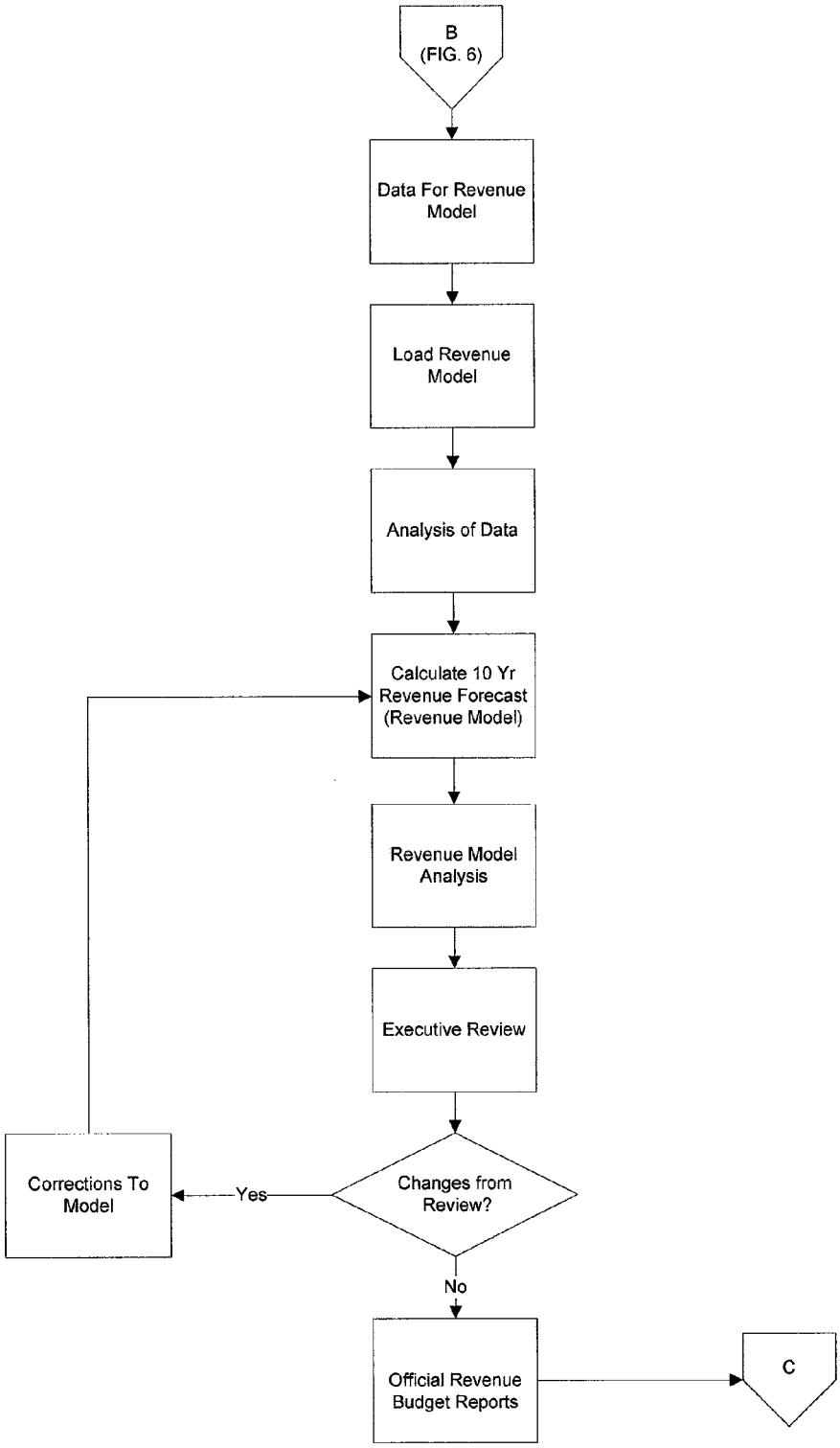
FIG. 7 illustrates an exemplary sequence of steps for the OATTIS revenue model.
Figure 8:
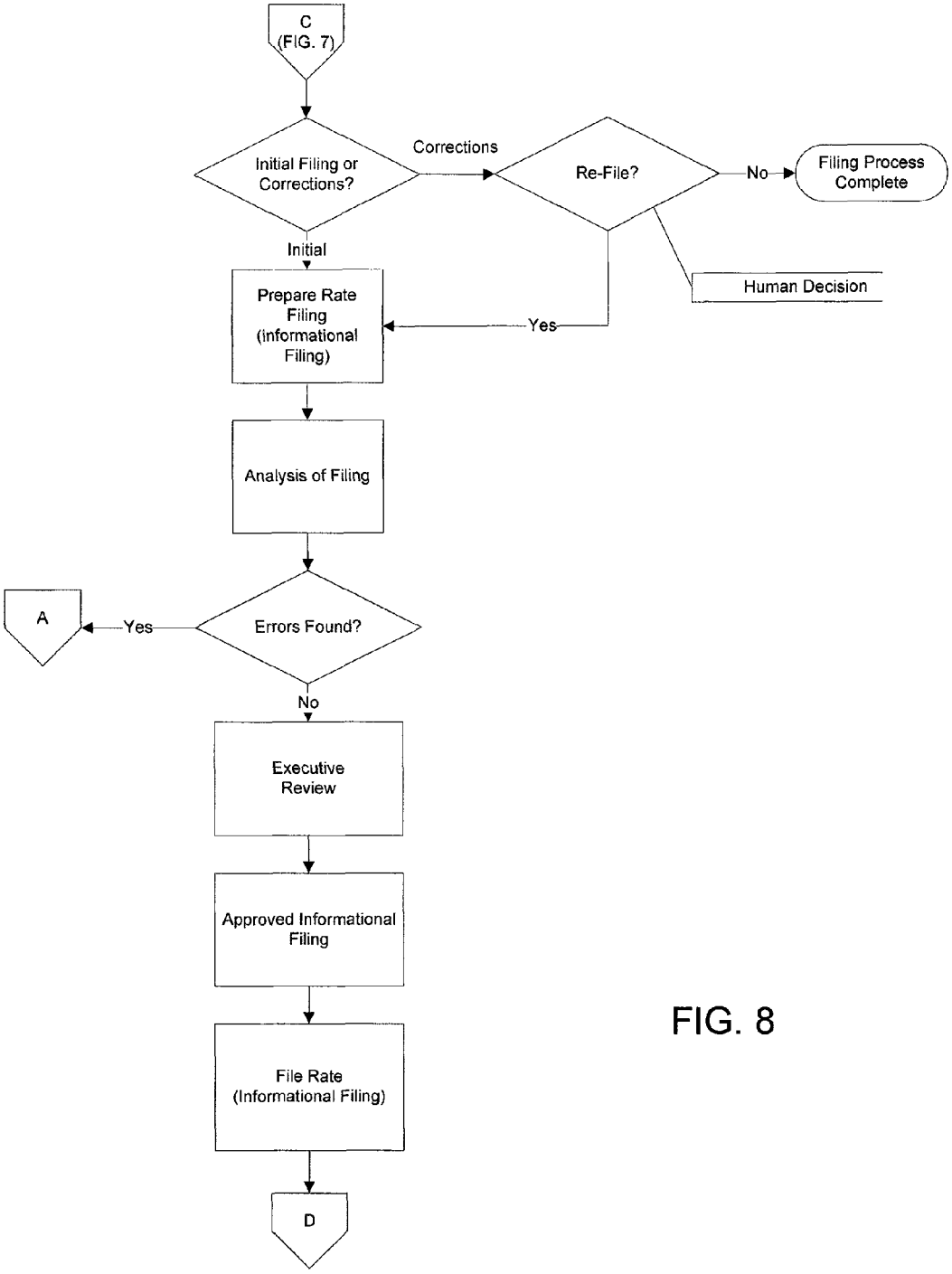
FIG. 8 illustrates an exemplary sequence of steps for the OATT Information Filing process.

FIG. 7 illustrates an exemplary revenue model for the OATTIS system. The budget rate model is a 10 year model derived from calculations on revenue data for each operating company. The rates are for wholesale transmission service for bulk and sub-transmission customers. After the budget rate to be billed during the next year is confirmed, the rate model is used to calculate nine additional years of bulk transmission and sub-transmission OATT Rates.

Figure 11:
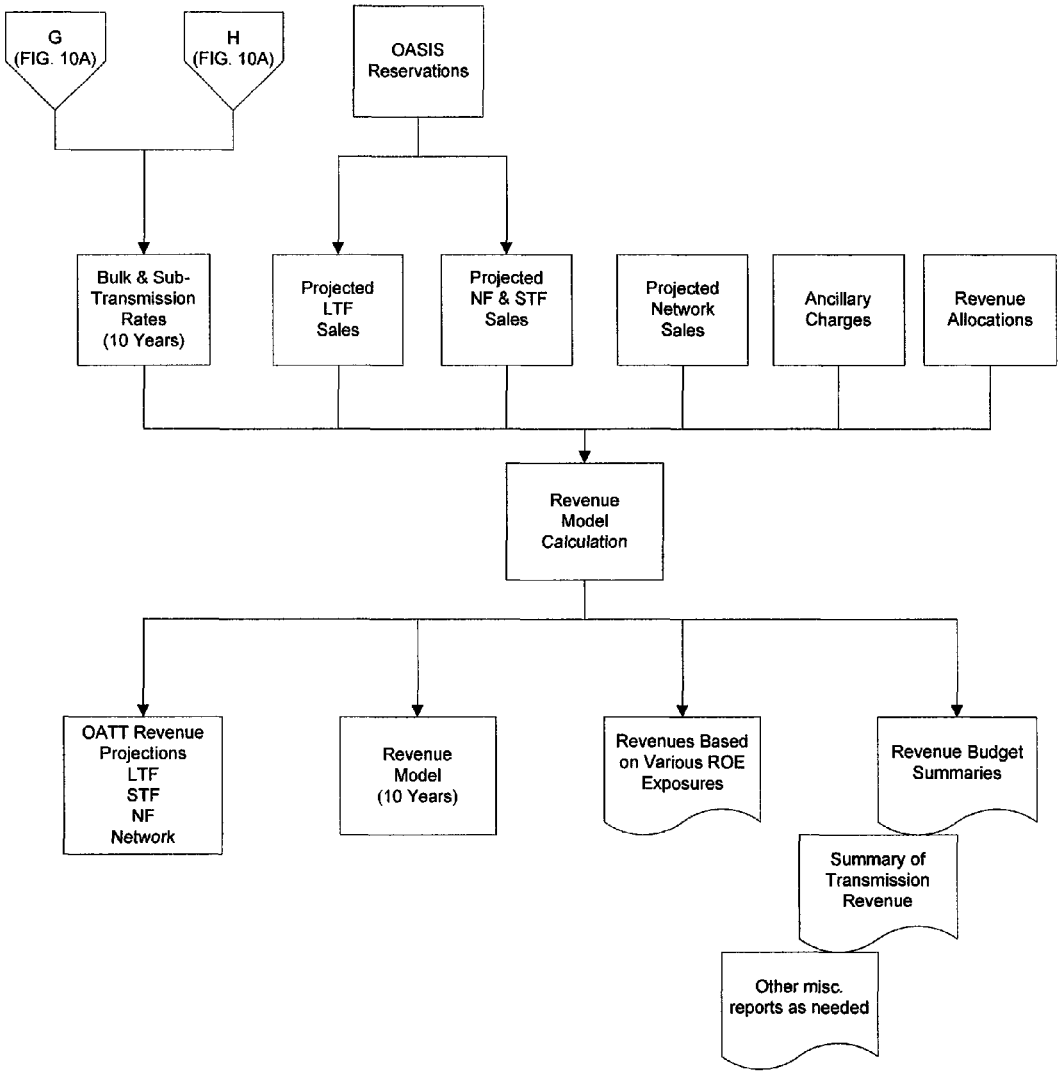
FIG. 11 illustrates an exemplary data flow for the OATTIS revenue model.

Projected sales data is requested from the following: Bulk Power Operations (projected Non-Firm and Short Term Firm), Transmission Billing (Long Term Firm), and Transmission Policy and Services (OASIS). A request for database reservation lookups from the OASIS reservation system is requested from Transmission Billing. Long Term Firm (LTF) sales projections are requested from the Transmission Policy Group looking for specific situations where rollover intentions are indicated. Transmission Billing also requests information where there is a strong potential for a new contract to be in place for future years to provide more LTF information. Twenty rates (i.e., 10 years for bulk transmission and 10 years for sub-transmission) are copied from the new budget rate model to populate the rates in the revenue model. The data that the data providers have input, pulled, validated and analyzed is loaded to the revenue model. The data that was loaded to the revenue model is analyzed before the revenue forecast calculation for reasonableness. FIG. 11 illustrates an exemplary data flow for the OATTIS revenue model.

The revenue model analysis sub-process compares the current in progress revenue model with the previous year revenue model for loads (bulk and sub-transmission) and revenue projections. The sub-process compares sales year over year. For the budget revenue model, one variance test is performed after the revenues have been calculated. In one exemplary embodiment, the current variance allowed could be 15%. Revenues can be calculated based on return on equity (ROE) exposures using different ROE levels.

Information Filing Process

Figure 12:
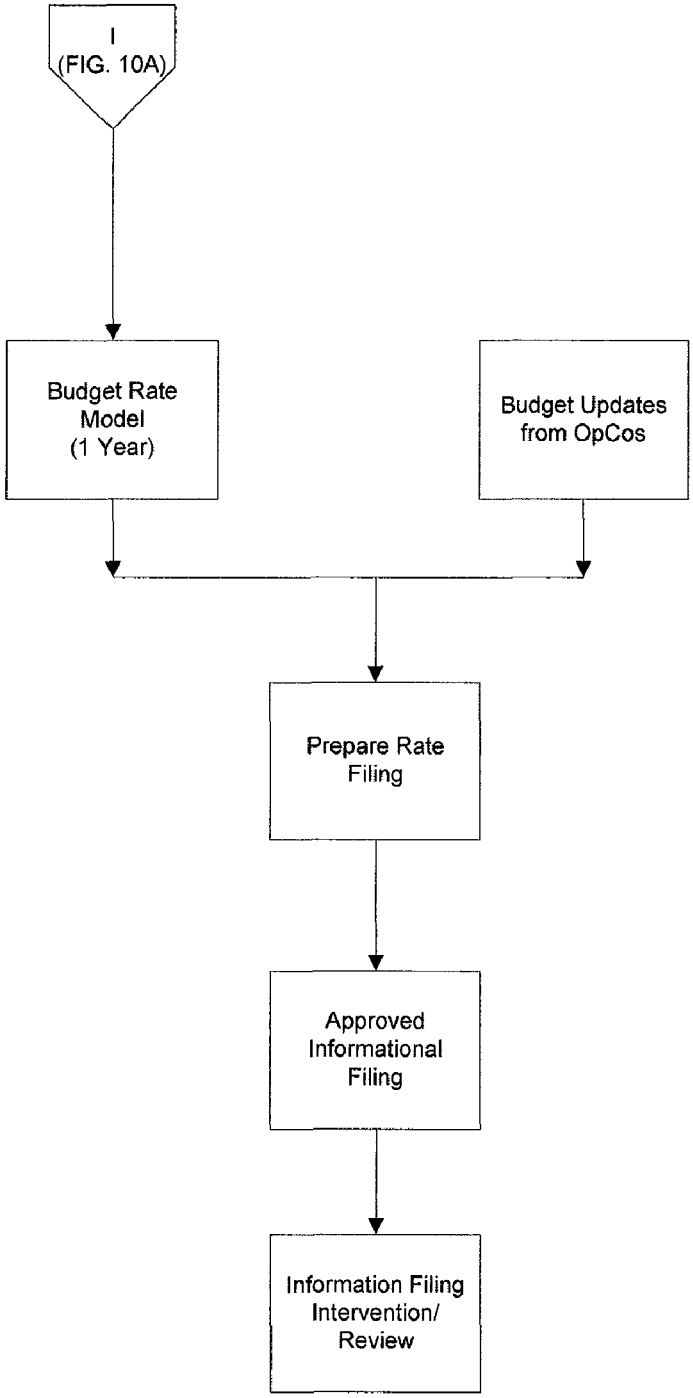
FIG. 12 illustrates an exemplary data flow for the OATTIS Informational Rate Filing.

The budget rate model process drives the Informational Filing process. The Informational Filing process begins immediately following the completion of the budget rate model process. This process incorporates more current data into the Information Filing which should decrease the possibility of deviations between the budget rate and the actual rate that will be calculated in the True-Up process. The Informational Filing contains the first budget year from the budget rate model and does not use the forecast years. FIG. 12 illustrates an exemplary data flow for the OATTIS Informational Rate Filing.

Figure 9:
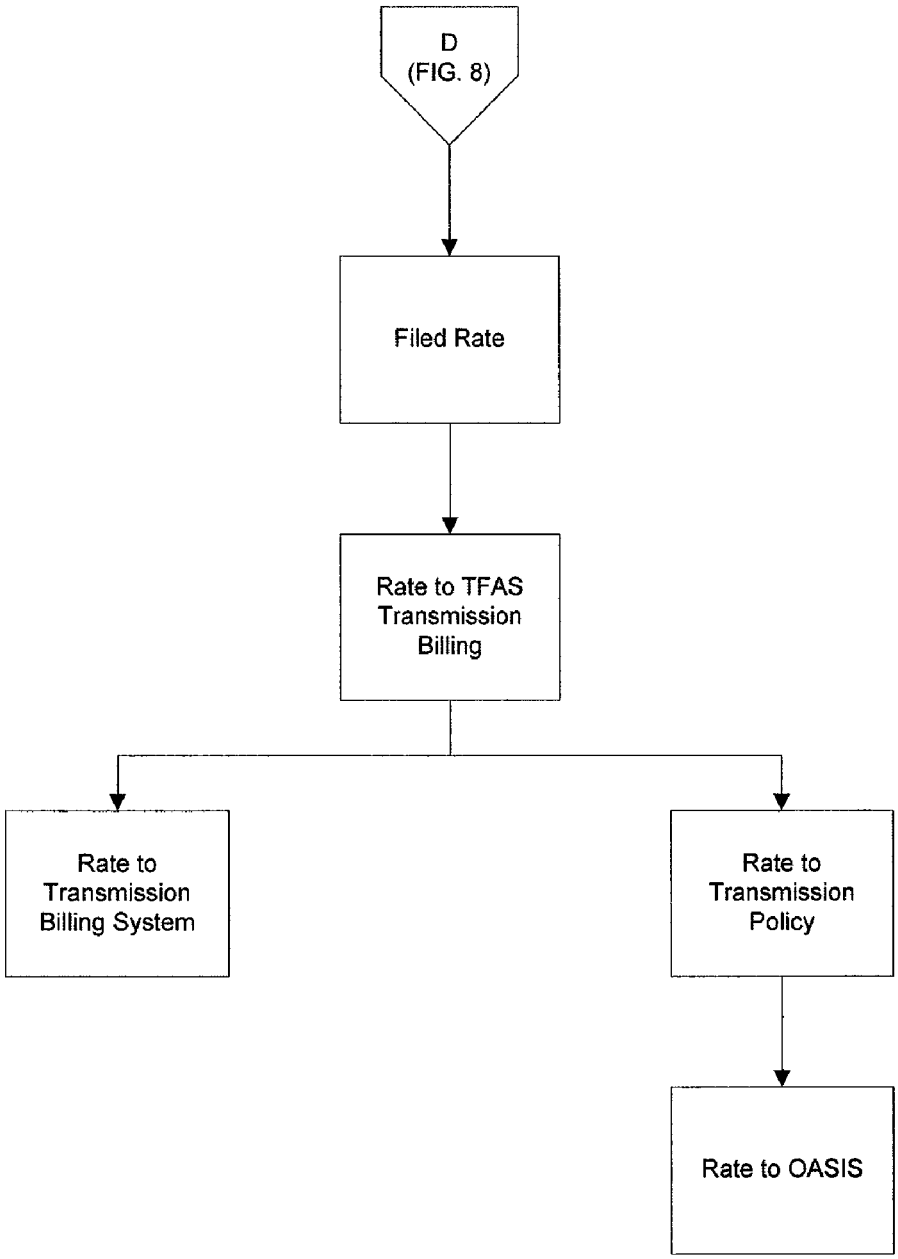
FIG. 9 illustrates an exemplary sequence of steps for the loading of the information rate data into the Transmission Billing System and OASIS.

When the filing has been completed and sent to FERC, electronic and hard copies of the filing are sent to the utility's transmission customers. The new rates are sent to the Transmission Billing System (TBS) and the OASIS reservation system. FIG. 9 illustrates the preceding steps in an exemplary embodiment.

Budget versus Actual Revenue Reporting Process

Figure 13:
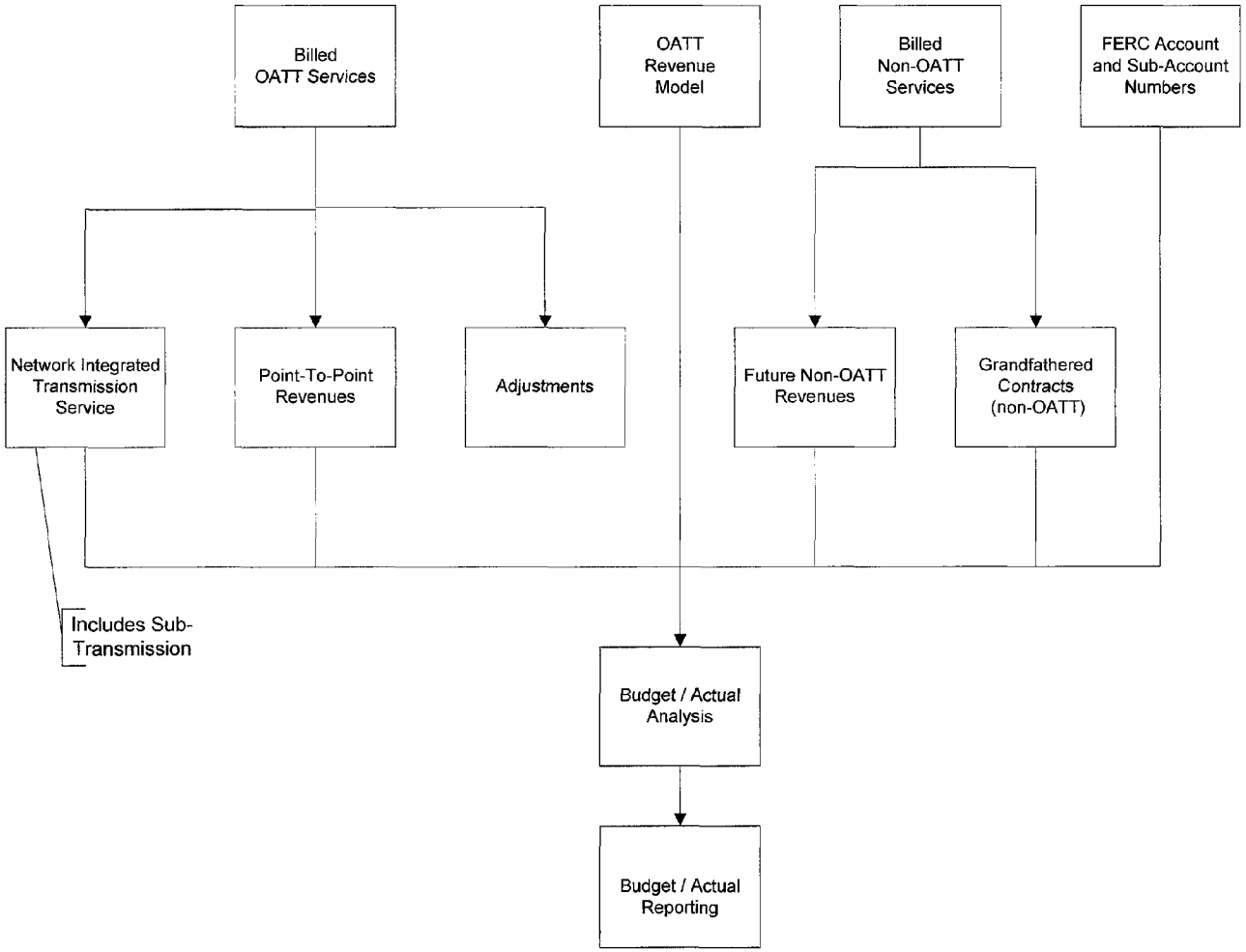
FIG. 13 illustrates an exemplary sequence of steps for the OATTIS budget versus actual revenue reporting process.

FIG. 13 illustrates an exemplary sequence of steps for the OATTIS budget versus actual revenue reporting process. Every month, the Transmission Billing group sends out a pool bill Invoice, which contains all of the OATT revenues for point-to-point (PTP), by firm and non-firm transmission service, and network customers. The pool invoice is a summary of everything sent out to the wholesale customers for the previous month's service. The primary use of the pool invoice is to verify the revenue data from the three inputs: network, PTP and utility power generation sub-transmission charges. The pool invoice also contains the utility power generation total network for all of the transmission service which is used to calculate the split between bulk and sub-transmission. Once all of the monthly actual information has been processed and has been cross-checked against the pool invoice (control document) and the current month's budget information has been updated in the annual budget, the budget to actual analysis is performed for the monthly reports.

OATT Quarterly Rate Analysis

Figure 14:
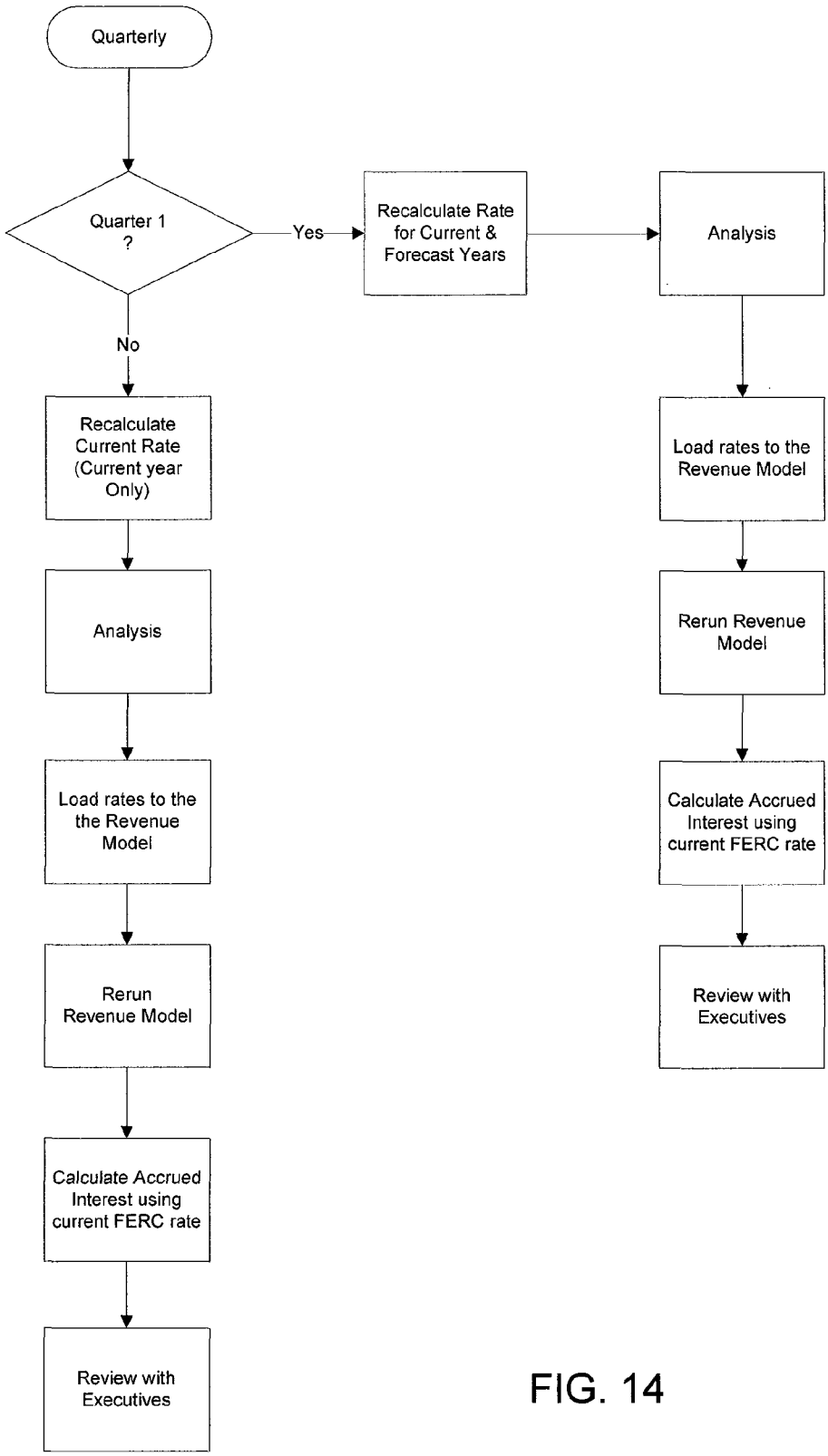
FIG. 14 illustrates an exemplary sequence of steps for the OATTIS quarterly rate analysis.

FIG. 14 illustrates an exemplary sequence of steps for the OATTIS quarterly rate analysis. There are two distinct processes involved depending on which quarter is being analyzed. The first quarter is essentially a repeat of the informational filing. The final/approved budget information is requested from the operating companies and the informational filing calculation process is repeated. For second, third, and fourth quarters, the process includes the update of several critical elements and the recalculation of the rate. In one embodiment, the critical elements are expected transmission plant investment, expected transmission operations and maintenance expenses, cost of debt, transmission loads, and collection of short term firm and non-firm charges.

Actual Rate Model

Figure 15:
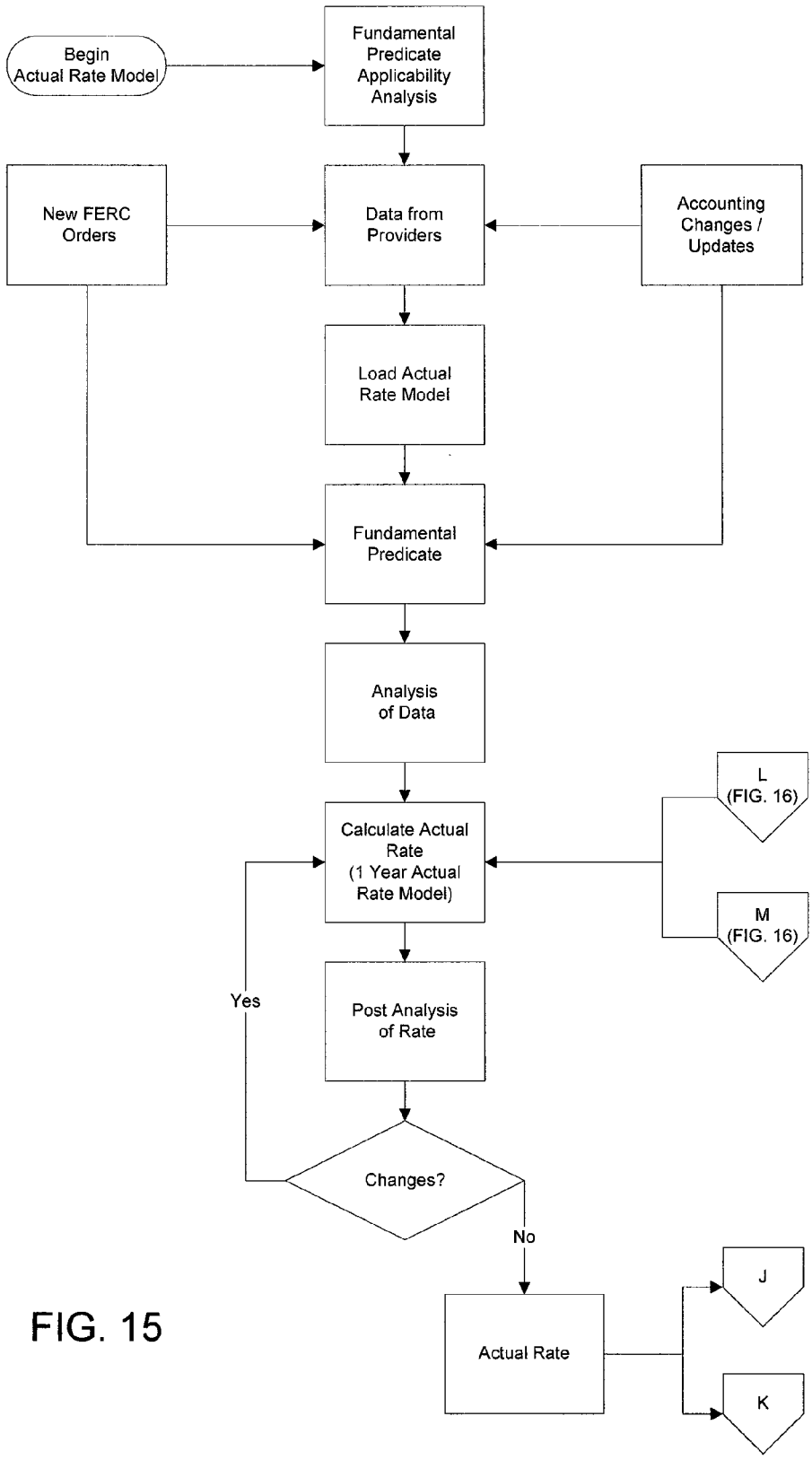
FIG. 15 illustrates an exemplary sequence of steps for the OATTIS actual rate model.

FIG. 15 illustrates an exemplary sequence of steps for the OATTIS actual rate model. The Actual Rate Model is modified/enhanced to reflect any accounting or regulatory changes that effect the model for the actual rate calculation. The new model structure, including changes and reasons for the changes, must be retained since it may be required to reply to intervener questions about the rate filed. The data released by the operating companies is then loaded to the Actual Rate Model.

Figure 18:
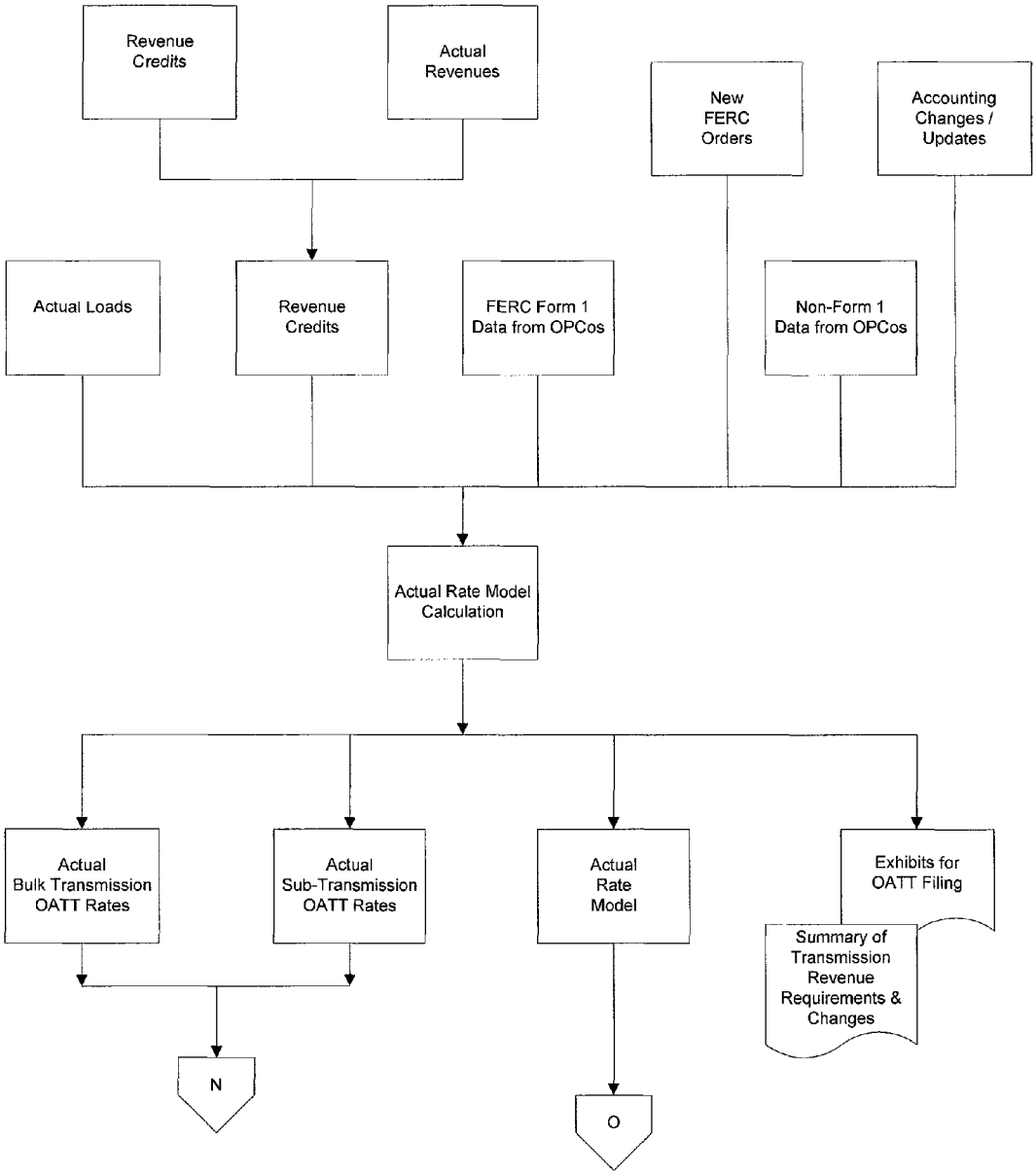
FIG. 18 illustrates exemplary data flows for the OATTIS actual rate model.

The data that has been loaded to the Actual Rate Model is analyzed before rate calculation for reasonableness. If large changes are found, clarification is requested from the supplying data provider. After the variance clarifications are negotiated with the data providers, any necessary changes are made to the data. The variances and clarification/explanation must be retained with the model for future use to answer intervener questions. FIG. 18 illustrates exemplary data flows for the OATTIS actual rate model.

After the OATT actual rates have been calculated, various analyses (+/− thresholds) are performed to determine the validity of the actual rate model and resulting rates. These analyses include: (1) calculated rate versus forecasted rate for the year; (2) calculated rate versus billed rate from prior year; (3) calculated rate versus actual rate from prior year; and (4) percent change (increase or decrease). If needed changes result from these analyses, the calculate rate sub-process would be repeated to reflect the changes.

Figure 19:
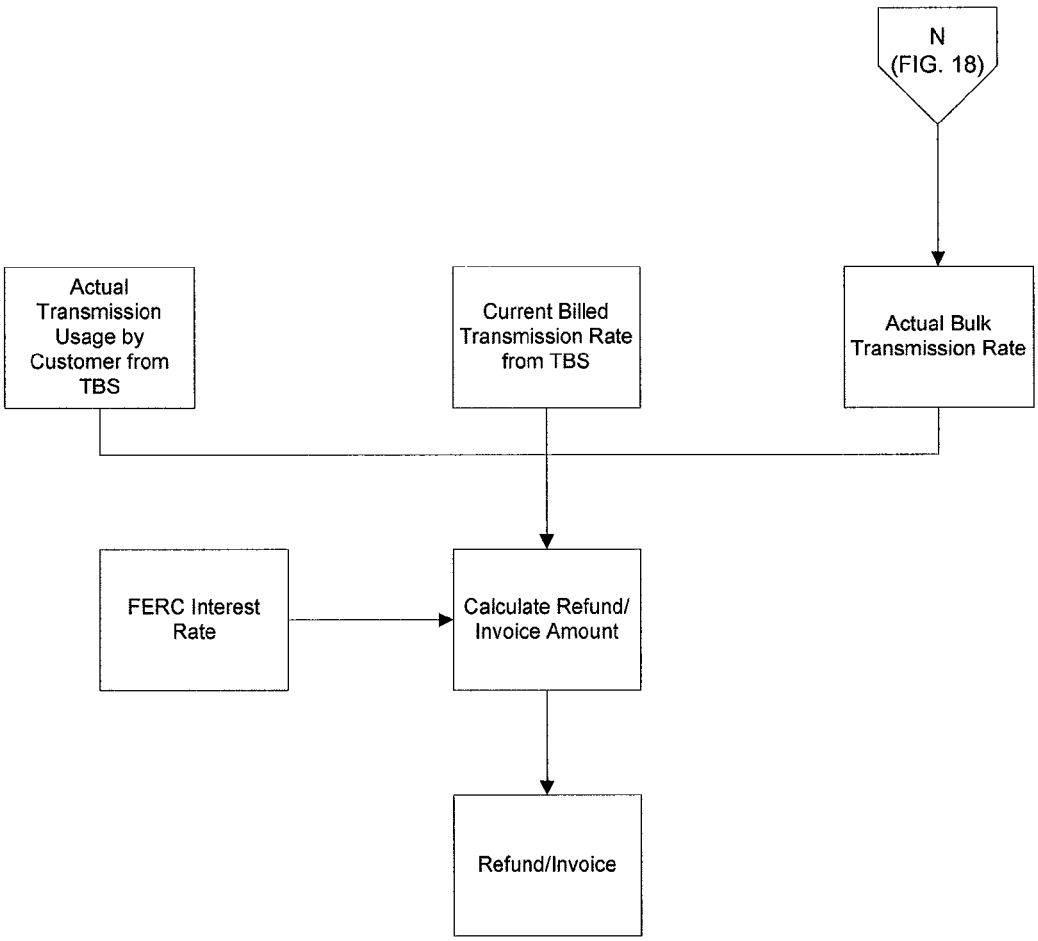
FIG. 19 illustrates exemplary data flows for the OATTIS refund estimate/actual revenue model.

The electric utility uses the Transmission Billing System to determine the transmission service levels for each wholesale customer for the previous year. The difference between the billed rate for that year for each service level/type and the trued-up rate is calculated for each customer. The difference is applied to the usage total to determine the potential refund or additional amount to be billed. In addition to the amount owed, or the refund due, the interest accrued is calculated using the current FERC interest rate. FIG. 19 illustrates exemplary data flows for the OATTIS refund estimate/actual revenue model.

OATT True-Up Filing Process

Figure 16:
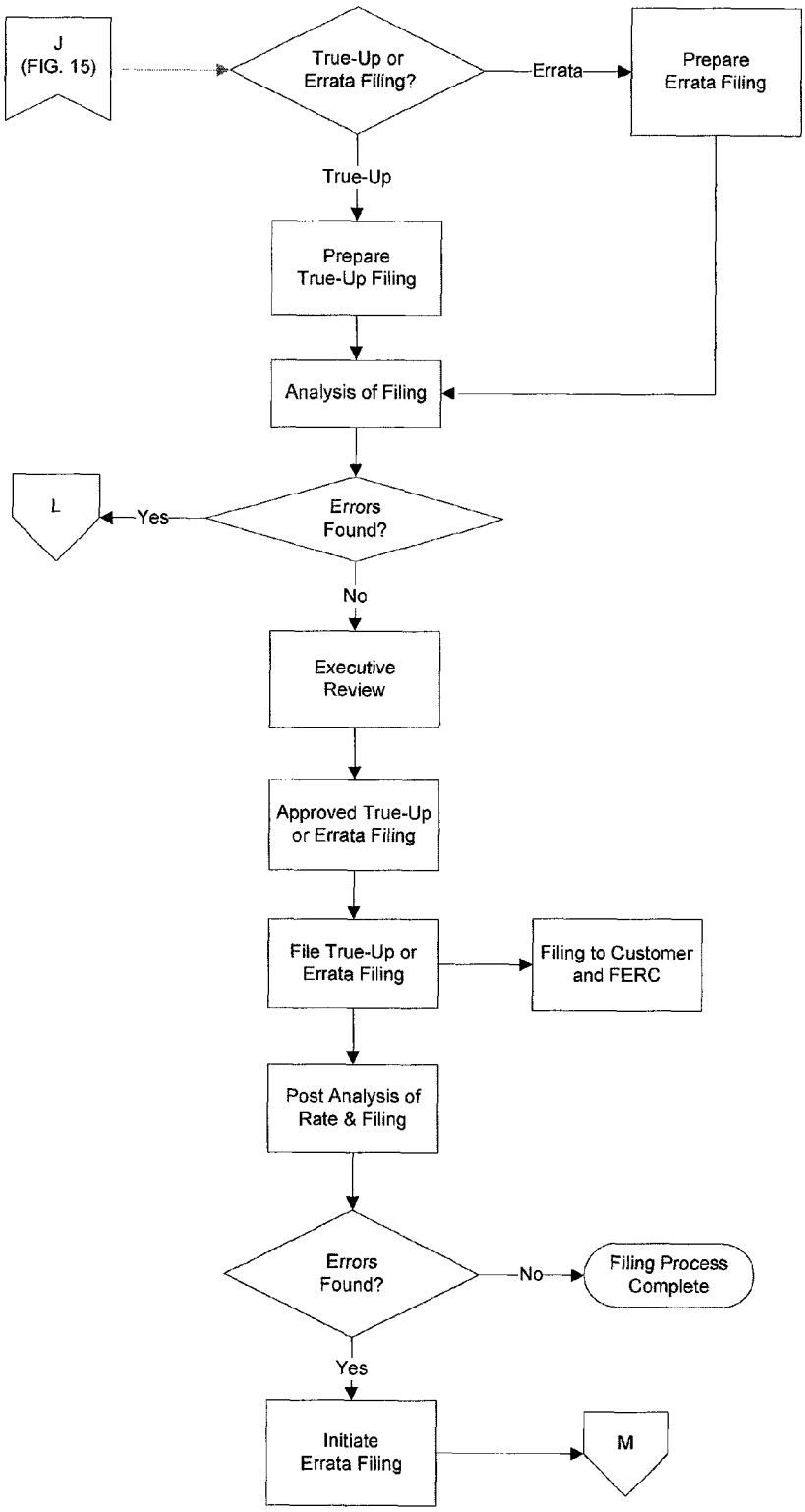
FIG. 16 illustrates an exemplary sequence of steps for the OATTIS true-up filing process.
Figure 20:
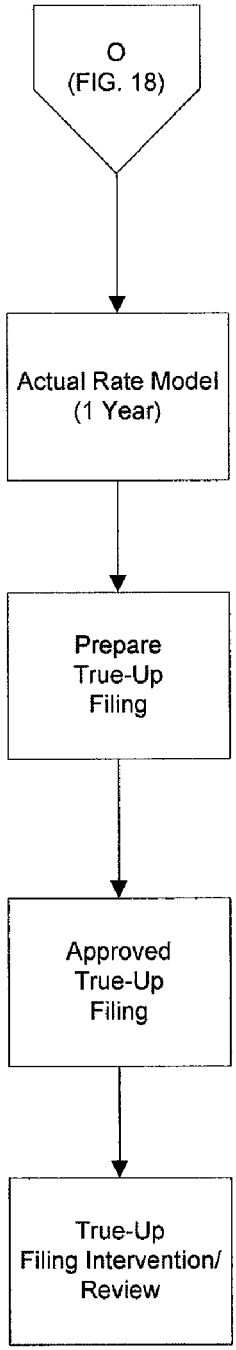
FIG. 20 illustrates exemplary data flows for the OATT rate true-up filing process.

After the Actual Rate has been finalized, it is processed through the True-Up Filing Process and the Actual Rate True-Up Process. FIG. 16 illustrates an exemplary sequence of steps for the OATTIS true-up filing process. The purpose of the true-up filing process is to satisfy regulatory requirements of the Federal Energy Regulatory Commission. Each electric utility is required to file a budget transmission rate on November 1 of each year which will determine the transmission billing rate for the following year. On May 1 of the year following the budget filing, when prior year actual data is available, a true-up filing is required. The true-up filing will determine the refund or additional billing that the utility will enact for long-term firm and network transmission customers who were billed at the budget rate during that year. Form 1 data and all other operating company data is obtained for this process. FIG. 20 illustrates exemplary data flows for the OATT rate true-up filing process.

Figure 17:
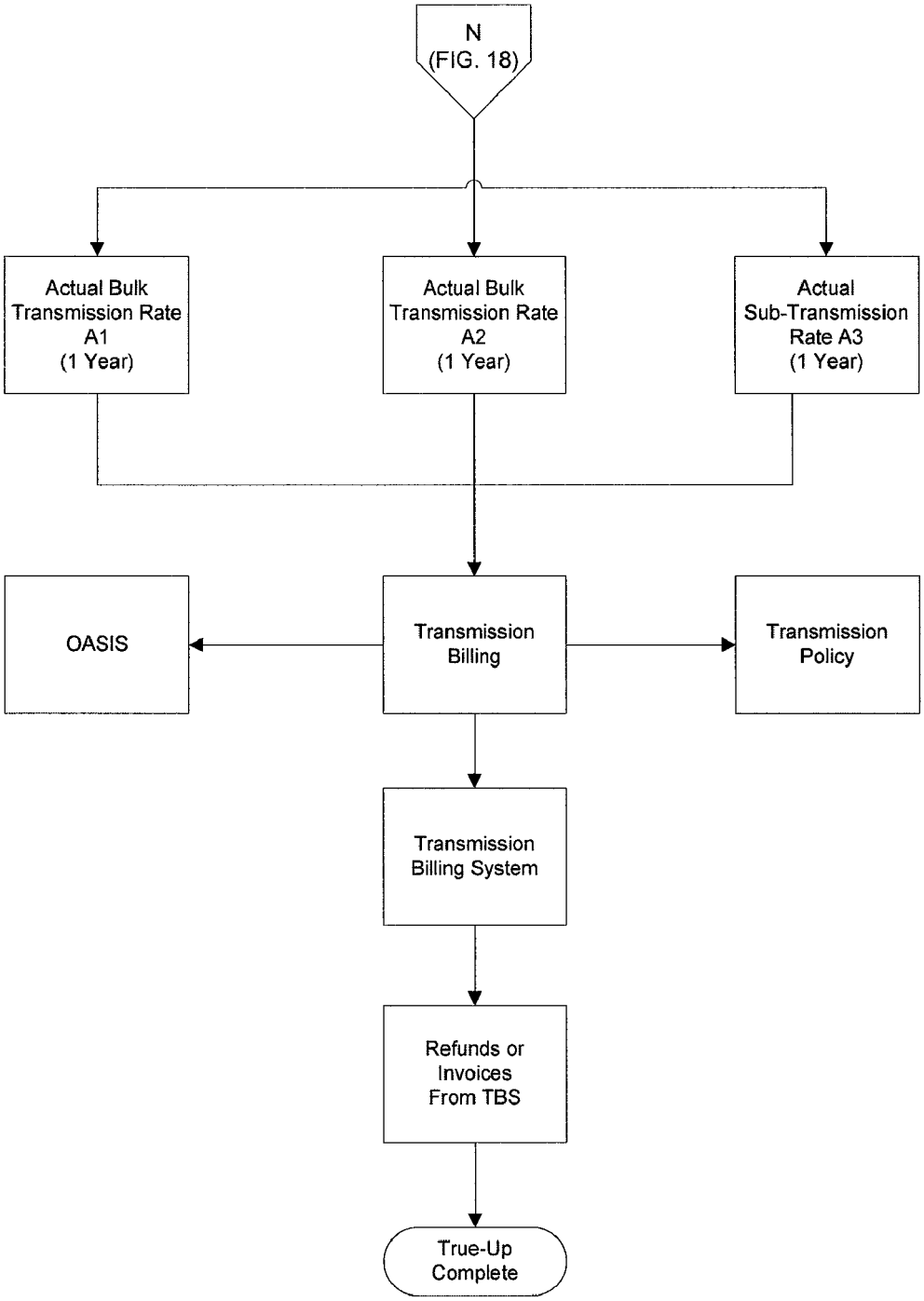
FIG. 17 illustrates an exemplary sequence of steps for the OATTIS actual true-up process.

FIG. 17 illustrates an exemplary sequence of steps for the OATTIS actual true-up process. After the actual rate has been filed through the true-up filing process, the actual rate is loaded to OASIS, and refunds or invoices are created through the Transmission Billing System.

Distribution Facilities Model

Figure 21:
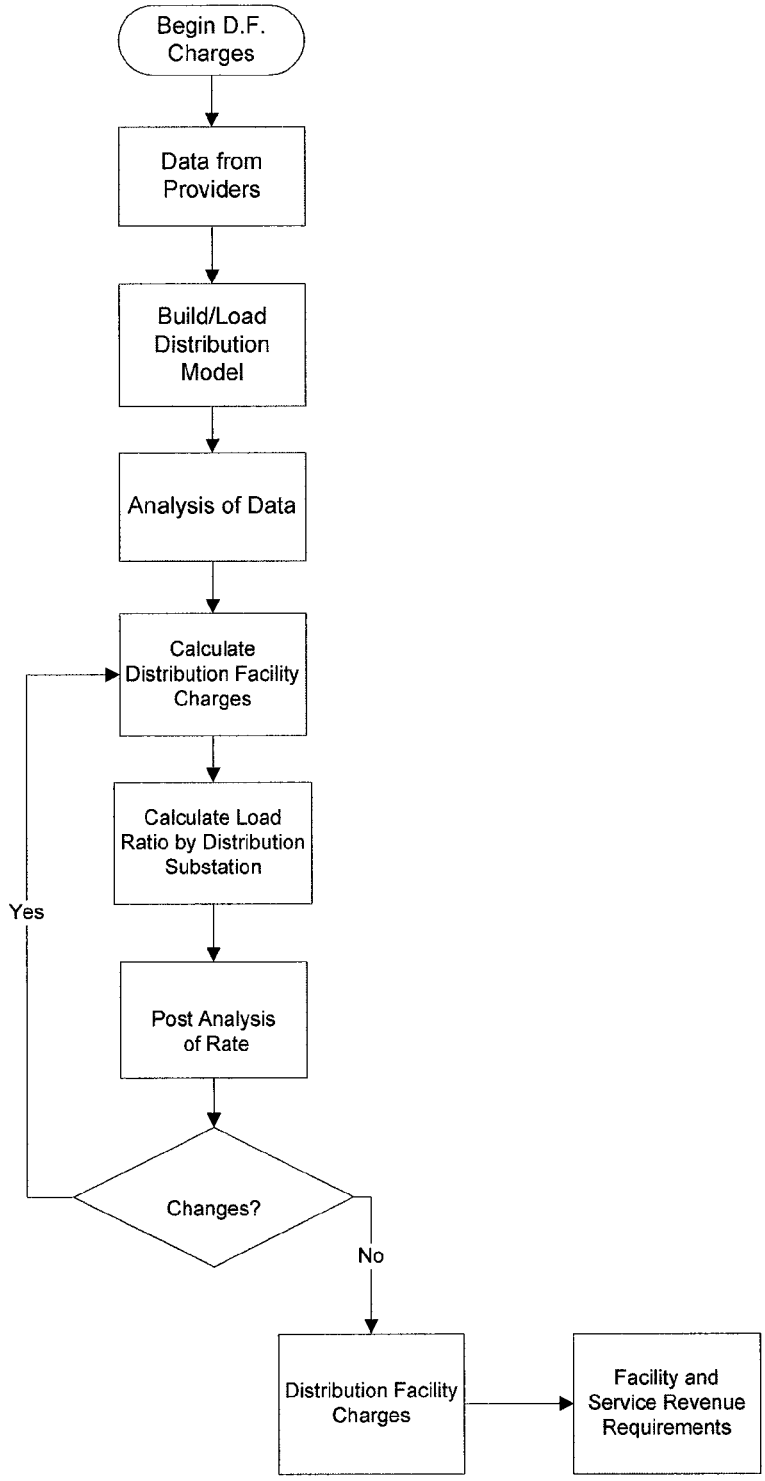
FIG. 21 illustrates an exemplary data flow for the OATTIS distribution model.

FIG. 21 illustrates an exemplary data flow for the OATTIS distribution facilities model. The distribution facilities model is derived by updating certain exhibits in the Actual Rate Model with Form 1 Distribution components, load data and gross investment and accumulated depreciation reserve balances. The distribution facility charges are for distribution facilities that are utilized for transmission services.

The function of the distribution facilities model process is to calculate the revenue requirements for distribution substations and lines. This process calculates a fixed charge for the transmission usage of distribution facilities. After the Actual Rate True-Up process is completed, additional information is extracted from Form 1 related to distribution accounts and used to develop the distribution model. Property accounting data and load data are two of the inputs into the distribution facilities model. Gross investment and accumulated depreciation reserve balances at end-of-year for each new or updated facility is provided by the utility's property accounting. Load information is provided monthly from each operating company. Customer load is determined at each distribution service level. Loss factors are applied for each level as appropriate. The load information can include, but is not limited to, total load for substation, total feeder load, customer load, and total distribution line miles.

The distribution facilities model is modified/enhanced to reflect any accounting or regulatory changes that effect the model for the distribution facility charge. The new model structure, including changes and reasons for the changes, must be retained. This information may be required to reply to intervener questions about the rate filed. The data released by the operating companies is then loaded to the distribution facilities model.

The data that has been loaded to the distribution facilities model is analyzed before calculation of distribution facility charge for reasonableness. If large changes are found, clarification is requested from the supplying data provider. After the variance clarifications are negotiated with the data providers, any necessary changes are made to the data. The variances and clarification/explanation must be retained with the model for future use to answer intervener questions.

The utility revenue requirement includes two components: a facility revenue requirement, and a service revenue requirement. The revenue requirement per facility is determined by prorating (1) the ratio of net investment to total investment for distribution substations, and (2) the ratio of line miles to total distribution line miles. The service revenue requirement for a specific service is determined, at least in part, by prorating (1) distribution substation revenue requirements based on ratio of customer load to specific distribution substation load, and (2) distribution line revenue requirements based on ratio of customer load to specific feeder load.

Embodiments of the invention have been described as computer-implemented processes. It is important to note, however, that those skilled in the art will appreciate that the mechanisms of the embodiments described are capable of being distributed as a program product in a variety of forms, and that the invention applies regardless of the particular type of computer readable storage media utilized to carry out the distribution. Examples of computer readable storage media include, without limitation, recordable-type media such as CompactFlash cards, portable hard drives, diskettes, CD ROMs, memory sticks, and flash drives.

The corresponding structures, materials, acts, and equivalents of all means plus function elements in any claims below are intended to include any structure, material, or acts for performing the function in combination with other claim elements as specifically claimed. Those skilled in the art will appreciate that many modifications to the exemplary embodiments are possible without departing from the scope of the present invention.

In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the present invention is defined solely by the appended claims.

What is claimed:

1. A web-based system for open access transmission tariff management for a regulated utility, comprising:

a database for storing a plurality of data pertaining to providing transmission service to wholesale customers;

a computer processor coupled to the database and cooperative with a plurality of subsystems including:

a subsystem for determining a budget transmission billing rate based on at least one of a plurality of forecast loads, revenue credits, and current budget data for the regulated utility stored in the database;

a subsystem for estimating revenue from wholesale customers based on the budget transmission billing rate and at least one of bulk transmission, sub-transmission, long term firm, short term firm, non-firm, and network service projections for the regulated utility stored in the database;

a subsystem for loading the budget transmission billing rate into a regulatory database and a transmission billing system for use in transmission line reservations and billings for wholesale customers;

a subsystem for generating a pool bill invoice monthly as a control document and reconciling the pool bill invoice with estimated revenues from wholesale customers, the pool bill invoice including revenues for point-to-point services, by firm and non-firm transmission services, and network customers;

a subsystem for determining an updated transmission billing rate and an updated revenue projection quarterly based on the monthly reconciliations between the pool bill invoice and the estimated revenues for each month in the quarter, and at least one of expected transmission plant investment, cost of debt, expected transmission operation and maintenance expenses, transmission loads and collection of short term and non-firm service charges in the second, third, and fourth quarters;

a subsystem for determining an actual transmission billing rate on an annual basis based on at least one of actual loads for bulk and sub-transmission, and revenue credits; and a subsystem for comparing the billed transmission rate with the actual transmission billing rate on an annual basis to prepare a true-up filing for wholesale customers; and a subsystem for generating invoices or refunds for wholesale customers based on the true-up filing.

2. The system for open access transmission tariff management of claim 1 further comprising a subsystem for determining a plurality of revenue requirements for a plurality of distribution substations and distribution lines.

3. The system for open access transmission tariff management of claim 1 wherein the plurality of revenue requirements includes a facility revenue requirement and a service revenue requirement.

4. The system for open access transmission tariff management of claim 1 further comprising a subsystem for analyzing a billed transmission rate on a quarterly basis by comparing an approved budget for transmission against actual revenue received.

5. The system for open access transmission tariff management of claim 4 wherein the subsystem for analyzing a billed transmission rate on a quarterly basis further includes a module for generating a report that explains a variance between the approved budget and actual revenue received.

6. The system for open access transmission tariff management of claim 1 wherein the subsystem for determining an actual transmission billing rate includes a module for validating the actual transmission billing rate by comparing a calculated rate against a forecast rate for a current year, comparing the calculated rate against the billed rate for a prior year, and determining a percentage change associated with each comparison.

7. A method for open access transmission tariff management for a regulated utility using a web-based computer system, comprising:

storing a plurality of data pertaining to providing transmission service to wholesale customers in a database;

determining a budget transmission billing rate, by the web-based computer system, based on at least one of a plurality of forecast loads, revenue credits, and current budget data for the regulated utility stored in the database;

estimating revenue from wholesale customers, by the web-based computer system, based on the budget transmission billing rate and at least one of a bulk transmission load forecast, a sub-transmission load forecast, long term firm, short term firm, non-firm, and network service projections for the regulated utility stored in the database;

loading the budget transmission billing rate into a regulatory database and a transmission billing system for use in transmission line reservations and billings for wholesale customers;

generating a pool bill invoice monthly as a control document and reconciling the pool bill invoice with estimated revenues from wholesale customers, the pool bill invoice including revenues for point-to-point services, by firm and non-firm transmission services, and network customers;

determining an updated transmission billing rate and an updated revenue projection quarterly, by the web-based computer system, based on the monthly reconciliations between the pool bill invoice and the estimated revenues for each month in the quarter, and at least one of expected transmission plant investment, cost of debt, expected transmission operation and maintenance expenses, transmission loads and collection of short term and non-firm service charges in the second, third, and fourth quarters;

determining an actual transmission billing rate on an annual basis, by the web-based computer system, based on at least one of actual loads for bulk and sub-transmission, and revenue credits; and comparing the billed transmission rate with the actual transmission billing rate on an annual basis, by the web-based computer system to prepare a true-up filing for wholesale customers; and generating invoices or refunds for wholesale customers based on the true-up filing.

8. The method for open access transmission tariff management of claim 7 further comprising determining, by the web-based computer system, a plurality of revenue requirements for a plurality of distribution substations and distribution lines.

9. The method for open access transmission tariff management of claim 7 further comprising determining a plurality of revenue requirements including a facility revenue requirement and a service revenue requirement.

10. The method for open access transmission tariff management of claim 7 further comprising analyzing a billed transmission rate on a quarterly basis by comparing an approved budget for transmission against actual revenue received.

11. The method for open access transmission tariff management of claim 10 wherein analyzing a billed transmission rate on a quarterly basis further comprises generating a report that explains a variance between the approved budget and actual revenue received.

12. The method for open access transmission tariff management of claim 7 wherein determining an actual transmission billing rate includes validating the actual transmission billing rate by comparing a calculated rate against a forecast rate for a current year, comparing the calculated rate against the billed rate for a prior year, and determining a percentage change associated with each comparison.

13. A computer readable storage medium for open access transmission tariff management for a regulated utility when operated on a computer system, comprising:

program instructions that store a plurality of data pertaining to providing transmission service to wholesale customers in a database;

program instructions that determine a budget transmission billing rate based on at least one of a plurality of forecast loads, revenue credits, and current budget data for the regulated utility stored in the database;

program instructions that estimate revenue from wholesale customers based on the budget transmission billing rate and at least one of bulk transmission, sub-transmission, long term firm, short term firm, non-firm, and network service projections for the regulated utility stored in the database;

program instructions that load the budget transmission billing rate into a regulatory database and a transmission billing system for use in transmission line reservations and billings for wholesale customers;

program instructions that generate a pool bill invoice monthly as a control document and reconcile the pool bill invoice with estimated revenues from wholesale customers, the pool bill invoice including revenues for point-to-point services, by firm and non-firm transmission services, and network customers;

program instructions that determine an updated transmission billing rate and an updated revenue projection quarterly based on the monthly reconciliations between the pool bill invoice and the estimated revenues for each month in the quarter, and at least one of expected transmission plant investment, cost of debt, expected transmission operation and maintenance expenses, transmission loads and collection of short term and non-firm service charges in the second, third, and fourth quarters;

program instructions that determine an actual transmission billing rate on an annual basis based on at least one of actual loads for bulk and sub-transmission, and revenue credits; and program instructions that compare the billed transmission rate with the actual transmission billing rate on an annual basis to prepare a true-up filing for wholesale customers; and program instructions that generate invoices or refunds for wholesale customers based on the true-up filing.

14. The computer readable storage medium for open access transmission tariff management of claim 13 further comprising program instructions that determine a plurality of revenue requirements for a plurality of distribution substations and distribution lines.

15. The computer readable storage medium for open access transmission tariff management of claim 13 further comprising program instructions that determine a plurality of revenue requirements including a facility revenue requirement and a service revenue requirement.

16. The computer readable storage medium for open access transmission tariff management of claim 13 further comprising program instructions that analyze a billed transmission rate on a quarterly basis by comparing an approved budget for transmission against actual revenue received.

17. The computer readable storage medium for open access transmission tariff management of claim 16 wherein the program instructions that analyze a billed transmission rate on a quarterly basis further comprise program instructions for generating a report that explains a variance between the approved budget and actual revenue received.

18. The computer readable storage medium for open access transmission tariff management of claim 13 wherein the program instructions that determine an actual transmission billing rate include program instructions that validate the actual transmission billing rate by comparing a calculated rate against a forecast rate for a current year, comparing the calculated rate against the billed rate for a prior year, and determining a percentage change associated with each comparison.

* * * * *